US009692140B2

(12) United States Patent
Hamabe

(10) Patent No.: US 9,692,140 B2
(45) Date of Patent: Jun. 27, 2017

(54) ANTENNA APPARATUS CAPABLE OF REDUCING DECREASES IN GAIN AND BANDWIDTH

(71) Applicant: Panasonic Corporation, Osaka (JP)

(72) Inventor: Taichi Hamabe, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 114 days.

(21) Appl. No.: 14/330,371

(22) Filed: Jul. 14, 2014

(65) Prior Publication Data

US 2014/0320379 A1 Oct. 30, 2014

Related U.S. Application Data

(63) Continuation of application No. PCT/JP2013/007445, filed on Dec. 18, 2013.

(30) Foreign Application Priority Data

Jan. 28, 2013 (JP) ..... 2013-012835

(51) Int. Cl.
*H01Q 21/00* (2006.01)
*H01Q 21/24* (2006.01)
(Continued)

(52) U.S. Cl.
CPC ..... *H01Q 21/0075* (2013.01); *H01Q 1/243* (2013.01); *H01Q 1/523* (2013.01);
(Continued)

(58) Field of Classification Search
CPC .... H01Q 21/0075; H01Q 21/24; H01Q 21/28; H01Q 1/243; H01Q 1/523; H01Q 9/42
(Continued)

(56) References Cited

U.S. PATENT DOCUMENTS 3,845,490 A * 10/1974 Manwarren ..... H01P 5/1007 333/238
7,443,352 B1 * 10/2008 Lin ..... G06F 1/1616 343/702
(Continued)

FOREIGN PATENT DOCUMENTS

JP 2001-326521 11/2001
JP 2002-76735 3/2002
(Continued)

OTHER PUBLICATIONS

International Search Report issued Mar. 18, 2014 in International (PCT) Application No. PCT/JP2013/007445.
(Continued)

*Primary Examiner* — Dameon E Levi
*Assistant Examiner* — Ab Salam Alkassim, Jr.
(74) *Attorney, Agent, or Firm* — Wenderoth, Lind & Ponack, L.L.P.

(57) ABSTRACT

An antenna apparatus is provided with an antenna and a ground conductor plate. The antenna is provided with: a dielectric substrate having a first surface and a second surface; a feed element having a strip shape and formed on the first surface of the dielectric substrate, the feed element having a first end connected to a feeding point, and an opened second end; and a parasitic element having a strip shape and formed on the second surface of the dielectric substrate, the parasitic element having a first end connected to the ground conductor plate, and an opened second end. The feed element and the parasitic element are arranged to oppose each other, at at least a portion including the second end of the feed element and the second end of the parasitic element.

20 Claims, 19 Drawing Sheets

(51) Int. Cl.
*H01Q 1/24* (2006.01)
*H01Q 21/28* (2006.01)
*H01Q 1/52* (2006.01)
*H01Q 9/42* (2006.01)

(52) U.S. Cl.
CPC ..... *H01Q 9/42* (2013.01); *H01Q 21/24* (2013.01); *H01Q 21/28* (2013.01)

(58) Field of Classification Search
USPC ..... 343/702, 893
See application file for complete search history.

(56) References Cited

U.S. PATENT DOCUMENTS

2001/0043159 A1 11/2001 Masuda et al.
2002/0024466 A1 2/2002 Masuda
2004/0056805 A1* 3/2004 Chen ..... H01Q 1/243 343/700 MS
2004/0196188 A1* 10/2004 Yeh ..... H01Q 1/38 343/700 MS
2006/0109179 A1 5/2006 Humpfer et al.
2007/0052591 A1* 3/2007 Chao ..... H01Q 9/42 343/700 MS
2008/0309562 A1* 12/2008 Tsutsumi ..... H01Q 1/2216 343/700 MS
2009/0051597 A1* 2/2009 Wen ..... H01Q 1/243 343/700 MS
2009/0189815 A1 7/2009 Hotta et al.
2009/0207092 A1* 8/2009 Nysen ..... H01Q 1/2275 343/876
2010/0231477 A1* 9/2010 Kuramoto ..... H01Q 9/26 343/795
2011/0012805 A1* 1/2011 Huang ..... H01Q 1/38 343/833
2011/0128193 A1* 6/2011 Arimura ..... H01Q 1/2275 343/702
2011/0165915 A1* 7/2011 Kim ..... H01Q 1/2266 455/566
2011/0260933 A1* 10/2011 Takahashi ..... H01Q 1/243 343/702
2012/0154240 A1 6/2012 Shirakawa et al.
2012/0249386 A1* 10/2012 Yanagi ..... H01Q 9/42 343/749
2012/0249393 A1 10/2012 Hotta et al.
2013/0099980 A1* 4/2013 Hayashi ..... H01Q 1/48 343/700 MS
2013/0257659 A1* 10/2013 Darnell ..... H01Q 1/243 343/702

FOREIGN PATENT DOCUMENTS

JP 2004-64282 2/2004
JP 2006-524940 11/2006
JP 2007-281906 10/2007
JP 2009-182608 8/2009
JP 2009-182786 8/2009
JP 2010-130115 6/2010
JP 2012-129856 7/2012
JP 2012-209752 10/2012
WO 02/058187 7/2002

OTHER PUBLICATIONS

Extended European Search Report issued Dec. 18, 2015 in European Application No. 13869857.6.
International Preliminary Report on Patentability issued Aug. 6, 2015 in International Application No. PCT/JP2013/007445 (English Translation).

* cited by examiner

ANTENNA APPARATUS CAPABLE OF REDUCING DECREASES IN GAIN AND BANDWIDTH

CROSS-REFERENCE TO RELATED APPLICATIONS

This is a continuation application of International Application No. PCT/JP2013/007445, with an international filing date of Dec. 18, 2013, which claims priority of Japanese Patent Application No. 2013-012835 filed on Jan. 28, 2013, the content of which is incorporated herein by reference.

BACKGROUND

1. Technical Field

The present disclosure relates to an antenna apparatus, a wireless communication apparatus provided with the antenna apparatus, and an electronic apparatus provided with the wireless communication apparatus.

2. Description of Related Art

Electronic apparatuses have been widely used, each electronic apparatus being provided with a wireless communication apparatus for receiving broadcast signals of, e.g., terrestrial digital television broadcast, and a display apparatus for displaying contents of the received broadcast signals. Various shapes and arrangements for antennas of the wireless communication apparatuses are proposed (e.g., see Japanese Patent laid-open Publication No. 2007-281906 A).

SUMMARY

In the case that an electronic apparatus provided with a wireless communication apparatus is configured as a mobile apparatus, an antenna of the wireless communication apparatus may be close to other metal components in the electronic apparatus, because of a limited size of a housing of the electronic apparatus. In this case, the gain of the antenna may decrease, since a current having a direction opposite to that of a current flowing in the antenna may flow in the metal components. In addition, the bandwidth of the antenna may decrease, due to a capacitance between the antenna and the metal components.

Further, in order to improve reception sensitivity, for example, an adaptive control may be performed, such as the combined diversity scheme, in which a plurality of antennas are provided inside or outside a housing of an electronic apparatus, and received signals received with the plurality of antennas are combined in phase. In this case, the problems of the decreases in the gain and in the bandwidth of the antennas may become more significant than those in the case of using one antenna.

One non-limiting and exemplary embodiment presents an antenna apparatus effective to reduce the decreases in the gain and in the bandwidth. In addition, the present disclosure presents a wireless communication apparatus provided with the antenna apparatus, and an electronic apparatus provided with the wireless communication apparatus.

An antenna apparatus of a general aspect of the present disclosure is provided with at least one antenna and a ground conductor plate. Each of the at least one antenna is provided with: a dielectric substrate having a first surface and a second surface; a first feed element having a strip shape and formed on the first surface of the dielectric substrate, the first feed element having a first end connected to a feeding point, and the first feed element having an opened second end; and a parasitic element having a strip shape and formed on the second surface of the dielectric substrate, the parasitic element having a first end connected to the ground conductor plate, and the parasitic element having an opened second end. The first feed element and the parasitic element are arranged to oppose each other, at at least a portion including the second end of the first feed element and the second end of the parasitic element.

Additional benefits and advantages of the disclosed embodiments will be apparent from the specification and Figures. The benefits and/or advantages may be individually provided by the various embodiments and features of the specification and drawings disclosure, and need not all be provided in order to obtain one or more of the same.

The antenna apparatus, the wireless communication apparatus, and the electronic apparatus of the present disclosure are effective to reduce the decreases in the gain and in the bandwidth of the antenna apparatus.

DETAILED DESCRIPTION

Embodiments are described in detail below with appropriate reference to the drawings. It is noted that excessively detailed explanation may be omitted. For example, detailed explanation on the already well-known matter, and repeated explanations on substantially the same configurations may be omitted. It is intended to avoid excessive redundancy of the following explanation and facilitate understanding of those skilled in the art.

The applicant provides accompanying drawings and the following explanation in order for those skilled in the art to fully understand the present disclosure, and does not intend to limit claimed subject matters by the drawings and explanation.

1. First Embodiment

Hereinafter, a first embodiment is described with reference to FIGS. 1 to 14.

[1-1. Configuration]

Figure 1:
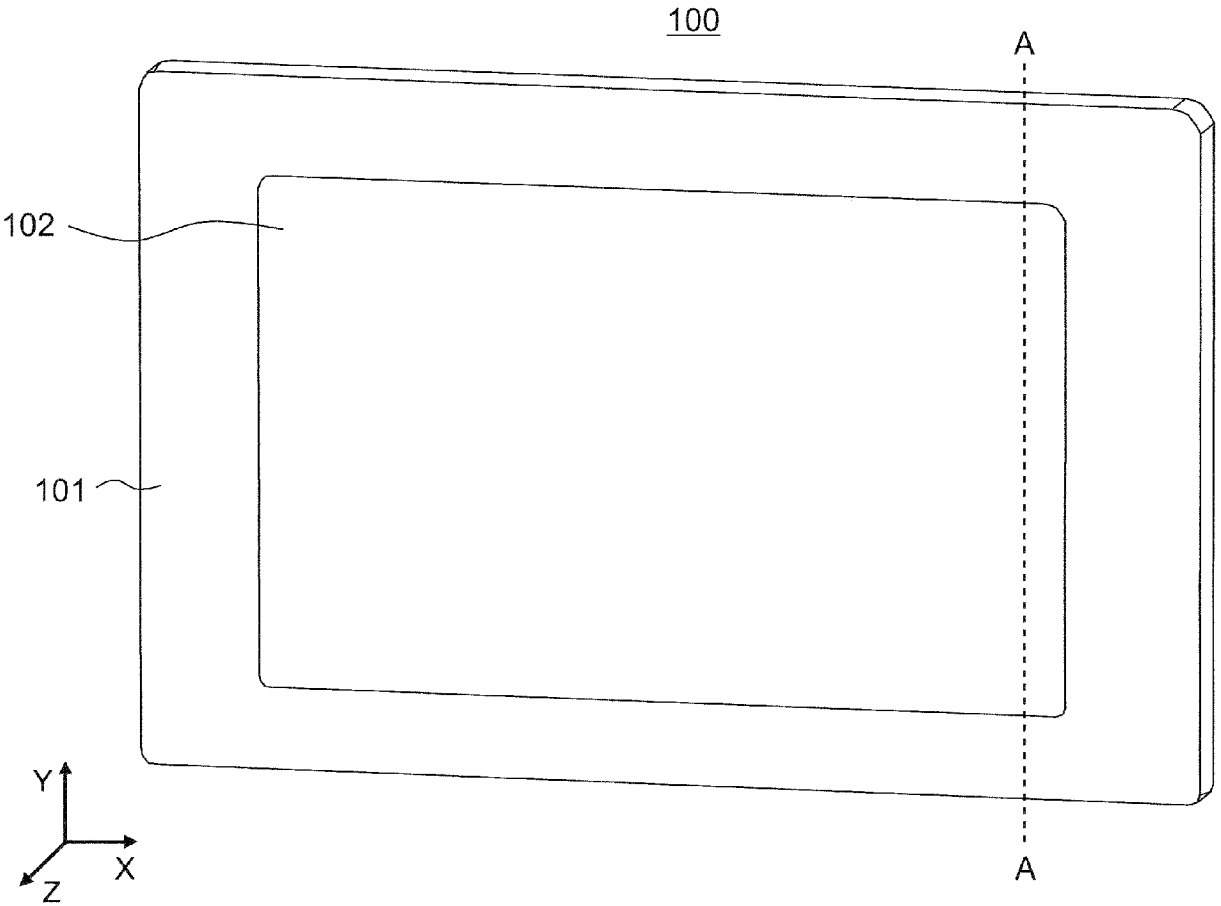
FIG. 1 is a perspective view showing an electronic apparatus 100 according to a first embodiment.
Figure 2:
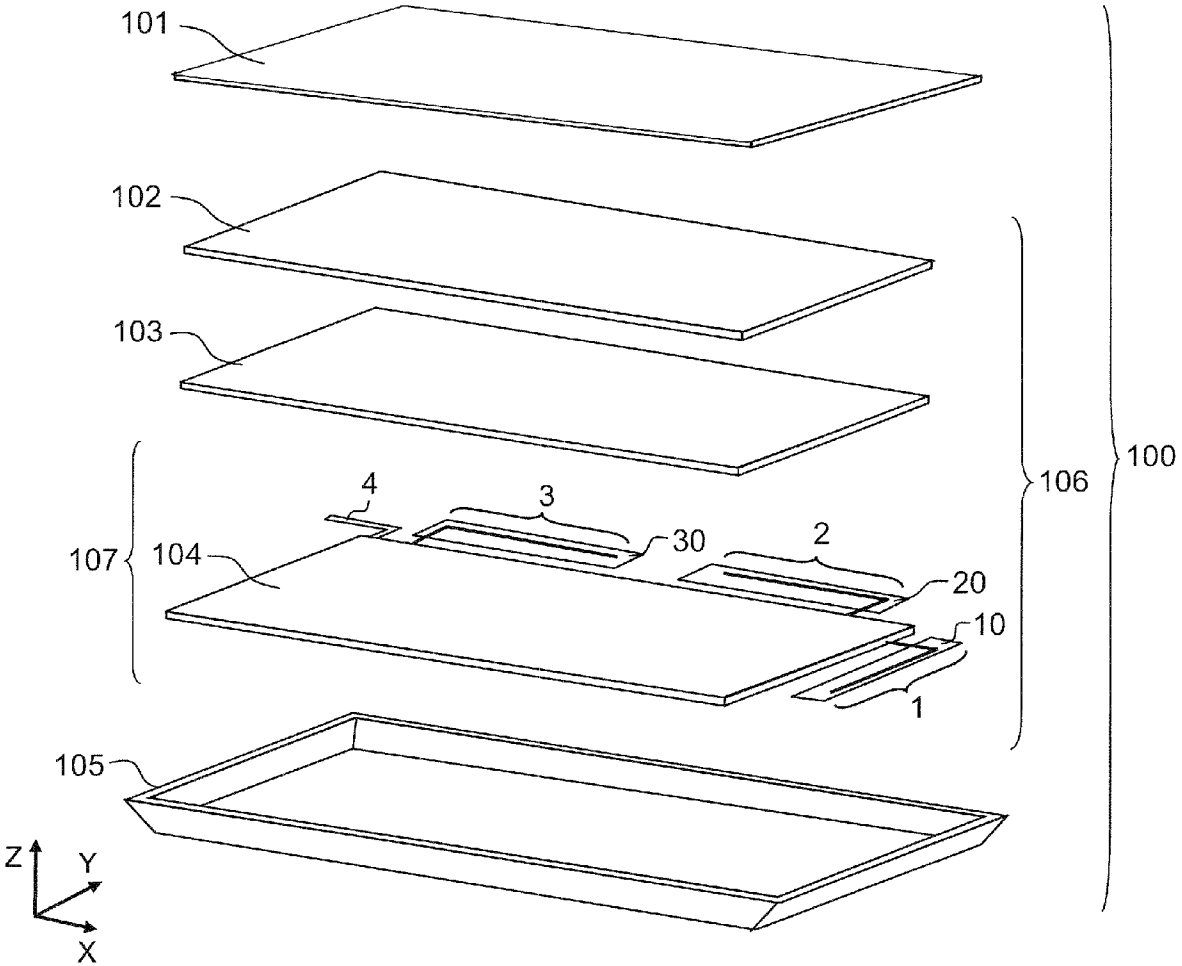
FIG. 2 is an exploded perspective view of the electronic apparatus 100 of FIG. 1.
Figure 3:
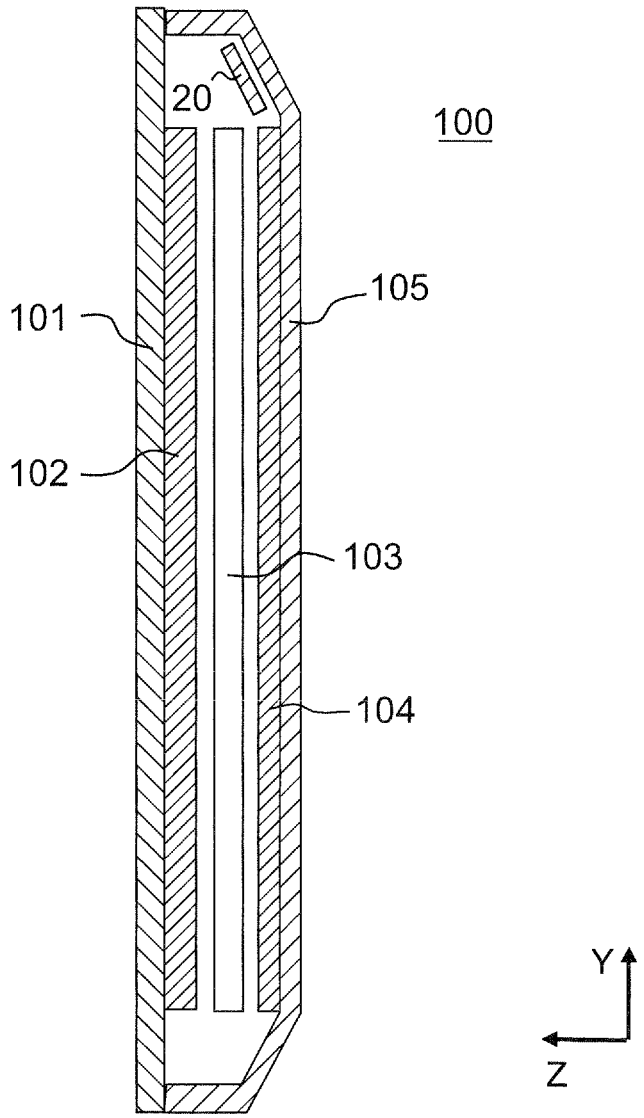
FIG. 3 is a cross-sectional view of the electronic apparatus 100 at an A-A line of FIG. 1.

FIG. 1 is a perspective view showing an electronic apparatus 100 according to a first embodiment. FIG. 2 is an exploded perspective view of the electronic apparatus 100 of FIG. 1. FIG. 3 is a cross-sectional view of the electronic apparatus 100 at an A-A line of FIG. 1. In the drawings, the XYZ coordinate shown in each drawing is referred to. With respect to FIG. 1, etc., the +Z side of the electronic apparatus 100 is called as "front", and the −Z side of the electronic apparatus 100 is called as "back". In addition, λ denotes a wavelength corresponding to a frequency "f" within an operating band of the electronic apparatus 100.

As shown in FIGS. 1 to 3, the electronic apparatus 100 is configured by installing a television receiving apparatus 106 within an outer housing, the outer housing including a front panel 101 and a back cover 105. The television receiving apparatus 106 includes a liquid crystal display (LCD) 102, a main circuit board 103, and an antenna apparatus 107. The antenna apparatus 107 is provided with: antennas 1 to 4 formed on dielectric substrates 10, 20, and 30, respectively; and a ground conductor plate 104. The ground conductor plate 104 is, e.g., a planar conductor component of the electronic apparatus 100. The ground conductor plate 104 has a size equivalent to, e.g., that of the liquid crystal display 102, and, e.g., has a rectangular shape with a length in X direction of λ/2, and a length in Y direction of λ/4. The ground conductor plate 104 is arranged, e.g., in a position close to and parallel to the liquid crystal display 102.

The back cover 105 may be configured by chamfering edges of +X, −X, +Y, and −Y sides on the back (see FIGS. 2 and 3). In this case, the dielectric substrates 10, 20, and 30 may be located at the chamfered portions of the back cover 105. As shown in FIG. 2, for example, the dielectric substrate 10 may be located at the chamfered portion of +X side of the back cover 105, and the dielectric substrates 20 and 30 may be located at the chamfered portion of +Y side of the back cover 105.

The electronic apparatus 100 of FIG. 1 is, e.g., a mobile apparatus for receiving broadcast signals of the frequency band of the terrestrial digital television broadcast (473 MHz to 767 MHz), and displaying their contents.

The main circuit board 103 includes a circuit for controlling operation of the entire electronic apparatus 100. In particular, the main circuit board 103 is, e.g., a printed circuit board, and provided with: a power supply circuit for supplying a power supply voltage to respective circuits on the main circuit board 103; a wireless receiving circuit (tuner); and an LCD driving circuit. The wireless receiving circuit is connected to antennas 1 to 4, respectively. The wireless receiving circuit processes four received signals received by the antennas 1 to 4, using the polarization diversity (i.e., weights the respective received signals according to the signal-to-noise ratio), and combines the four received signals to one received signal. The wireless receiving circuit outputs video signals and audio signals contained in the combined received signal. In addition, the LCD driving circuit performs certain image processing on the video signals from the wireless receiving circuit, and drives the liquid crystal display 102 to display an image. Further, the electronic apparatus 100 is provided with components, such as, voice processing circuit for performing certain processing on the audio signals from the wireless receiving circuit, a speaker for outputting the processed audio signals, a recorder apparatus and a player apparatus for the video signals and the audio signals, and a metal member for radiation to reduce heat generated from components, such as the main circuit board 103 (not shown).

The antenna apparatus 107 provided with the antennas 1 to 4, and the wireless receiving circuit on the main circuit board 103 make up a wireless communication apparatus which receives the radio signals.

Figure 4:
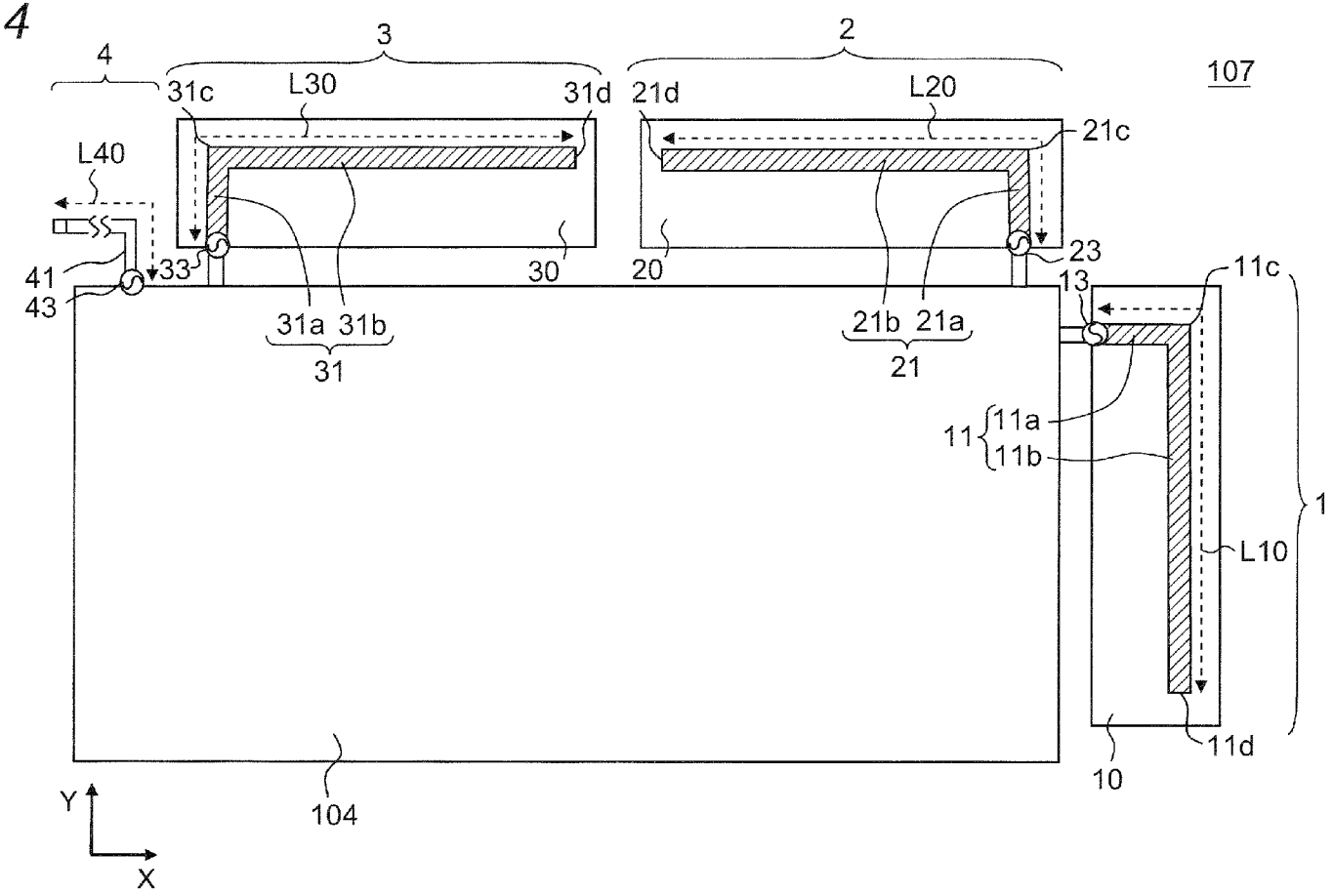
FIG. 4 is a plan view of an antenna apparatus 107 of FIG. 2, seen from a front side thereof.
Figure 5:
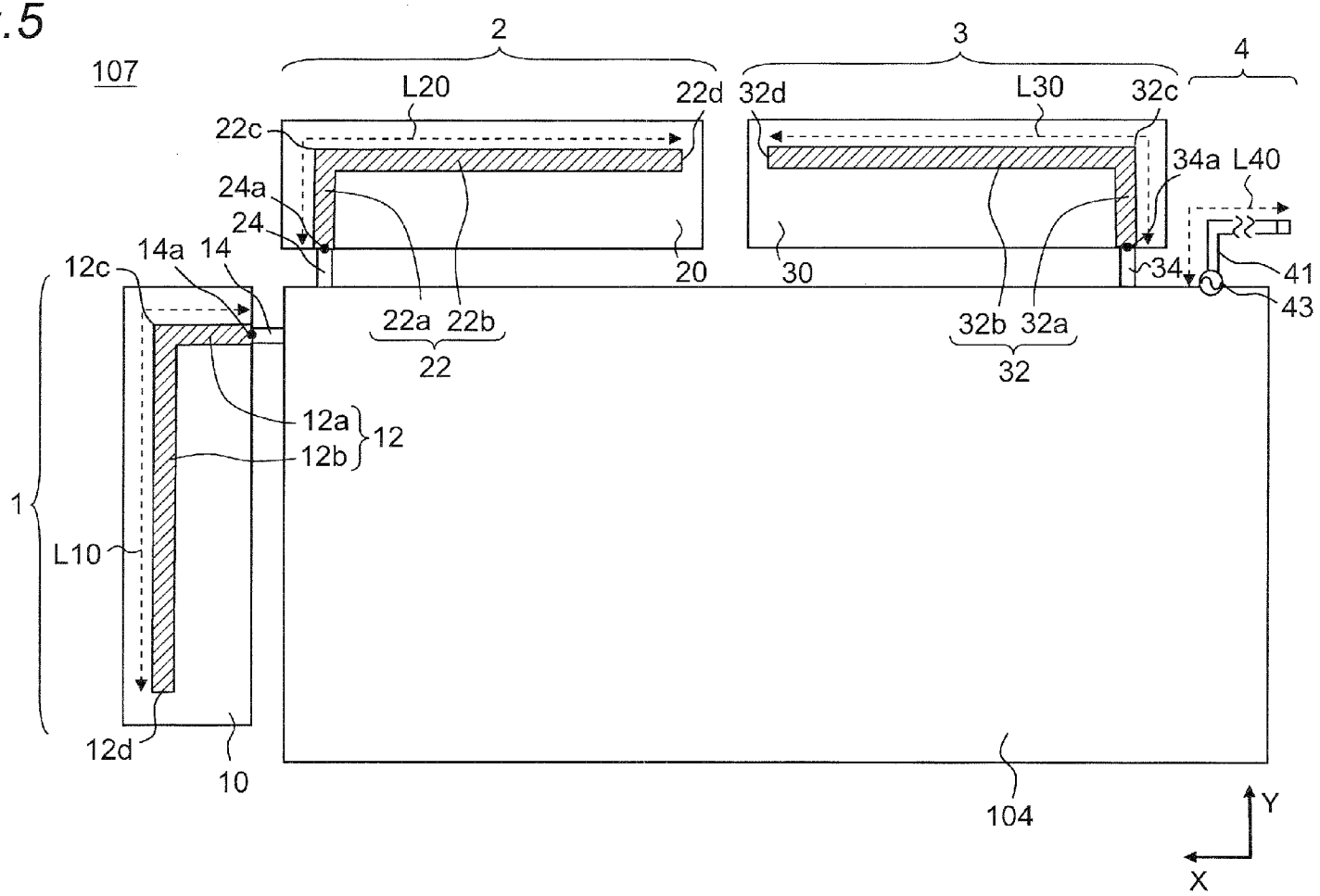
FIG. 5 is a plan view of the antenna apparatus 107 of FIG. 2, seen from a back side thereof.

FIG. 4 is a plan view of the antenna apparatus 107 of FIG. 2, seen from a front side thereof. FIG. 5 is a plan view of the antenna apparatus 107 of FIG. 2, seen from a back side thereof. The front side of the antenna apparatus 107 opposes the main circuit board 103, and the back side of the antenna apparatus 107 opposes the back cover 105.

First, the antenna 1 is explained.

The antenna 1 is provided with: a dielectric substrate 10, a feed element 11 having a strip shape and formed on the front side of the dielectric substrate 10 (FIG. 4), and a parasitic element 12 having a strip shape and formed on the back side of the dielectric substrate 10 (FIG. 5). The feed element 11 and the parasitic element 12 are made of conductive foil, such as copper or silver. The dielectric substrate 10, the feed element 11, and the parasitic element 12 are configured as, e.g., a printed-circuit board having conductor layers on both sides.

As shown in FIGS. 4 and 5, the feed element 11 and the parasitic element 12 may be formed to be of, e.g., an inverted-L type. Referring to FIG. 4, the feed element 11 includes element parts 11*a* and 11*b*, which are connected to each other at a connecting point 11*c*. The element part 11*a* extends substantially toward the +X direction from a position close to the ground conductor plate 104. The element part 11*a* is connected to a feeding point 13 at one end of the element part 11*a*, and connected to the element part 11*b* at the connecting point 11*c* of the other end of the element part 11*a*. The element part 11*b* extends substantially toward the −Y direction from the connecting point 11*c*. The element part 11*b* is opened at an open end 11*d* of one end of the element part 11*b*, and connected to the element part 11*a* at the connecting point 11*c* of the other end of the element part 11*b*. Referring to FIG. 5, the parasitic element 12 includes element parts 12*a* and 12*b*, which are connected to each other at a connecting point 12*c*. The element part 12*a* extends substantially toward the +X direction from a position close to the ground conductor plate 104. The element part 12*a* is connected to a connecting conductor 14 at a connecting point 14*a* located at one end of the element part 12*a*, and grounded to an edge of the ground conductor plate 104 through the connecting conductor 14. The element part 12*a* is connected to the element part 12*b* at the connecting point 12*c* of the other end of the element part 12*a*. The element part 12*b* extends substantially toward the −Y direction from the connecting point 12*c*. The element part 12*b* is opened at an open end 12*d* of one end of the element part 12*b*, and connected to the element part 12*a* at the connecting point 12*c* of the other end of the element part 12*b*.

As described above, the feed element 11 has the end connected to the feeding point 13 (first end), and the open end 11*d* (second end). The parasitic element 12 has the end connected to the ground conductor plate 104 (first end), and the open end 12*d* (second end). The feed element 11 and the parasitic element 12 are arranged to oppose each other, at at least a portion including the open end 11*d* of the feed element 11 and the open end 12*d* of the parasitic element 12.

The feed element 11 and the parasitic element 12 may be arranged to be capacitively coupled to each other, at at least a portion including the open end 11*d* of the feed element 11 and the open end 12*d* of the parasitic element 12. In this case, since the open end 11*d* of the feed element 11 and the open end 12*d* of the parasitic element 12 are capacitively coupled to each other, the antenna 1 operates as a folded antenna including the feed element 11 and the parasitic element 12, and being folded at the open ends 11*d* and 12*d*. An electric length L10 of each of the feed element 11 and the parasitic element 12 capacitively coupled to each other is set to λ/4, and therefore, an electric length of the folded antenna is set to λ/2, and the folded antenna resonates at the frequency f. Thus, the feed element 11 and the parasitic element 12 resonate at the frequency f corresponding to the wavelength λ determined by the sum of the electric length L10 of the feed element 11 and the electric length L10 of the parasitic element 12.

The feed element 11 and the parasitic element 12 may be arranged to overlap each other, at at least a portion including the open end 11*d* of the feed element 11 and the open end 12*d* of the parasitic element 12.

Now, the antenna 2 is explained.

The antenna 2 is provided with: a dielectric substrate 20, a feed element 21 having a strip shape and formed on the front side of the dielectric substrate 20 (FIG. 4), and a parasitic element 22 having a strip shape and formed on the back side of the dielectric substrate 20 (FIG. 5). The feed element 21 and the parasitic element 22 are made of conductive foil, such as copper or silver. The dielectric substrate 20, the feed element 21, and the parasitic element 22 are configured as, e.g., a printed-circuit board having conductor layers on both sides.

As shown in FIGS. 4 and 5, the feed element 21 and the parasitic element 22 may be formed to be of, e.g., an inverted-L type. Referring to FIG. 4, the feed element 21 includes element parts 21*a* and 21*b*, which are connected to each other at a connecting point 21*c*. The element part 21*a* extends substantially toward the +Y direction from a position close to the ground conductor plate 104. The element part 21*a* is connected to a feeding point 23 at one end of the element part 21*a*, and connected to the element part 21*b* at the connecting point 21*c* of the other end of the element part 21*a*. The element part 21*b* extends substantially toward the −X direction from the connecting point 21*c*. The element part 21*b* is opened at an open end 21*d* of one end of the element part 21*b*, and connected to the element part 21*a* at the connecting point 21*c* of the other end of the element part 21*b*. Referring to FIG. 5, the parasitic element 22 includes element parts 22*a* and 22*b*, which are connected to each other at a connecting point 22*c*. The element part 22*a* extends substantially toward the +Y direction from a position close to the ground conductor plate 104. The element part 12*a* is connected to a connecting conductor 24 at a connecting point 24*a* located at one end of the element part 22*a*, and grounded to an edge of the ground conductor plate 104 through the connecting conductor 24. The element part 22*a* is connected to the element part 22*b* at the connecting point 22*c* of the other end of the element part 22*a*. The element part 22*b* extends substantially toward the −X direction from the connecting point 22*c*. The element part 22*b* is opened at an open end 22*d* of one end of the element part 22*b*, and connected to the element part 22*a* at the connecting point 22*c* of the other end of the element part 22*b*.

As described above, the feed element 21 has the end connected to the feeding point 23 (first end), and the open end 21*d* (second end). The parasitic element 22 has the end connected to the ground conductor plate 104 (first end), and the open end 22*d* (second end). The feed element 21 and the parasitic element 22 are arranged to oppose each other, at at least a portion including the open end 21*d* of the feed element 21 and the open end 22*d* of the parasitic element 22.

The feed element 21 and the parasitic element 22 may be arranged to be capacitively coupled to each other, at at least a portion including the open end 21*d* of the feed element 21 and the open end 22*d* of the parasitic element 22. In this case, since the open end 21*d* of the feed element 21 and the open end 22*d* of the parasitic element 22 are capacitively coupled to each other, the antenna 2 operates as a folded antenna including the feed element 21 and the parasitic element 22, and being folded at the open ends 21*d* and 22*d*. An electric length L20 of each of the feed element 21 and the parasitic element 22 capacitively coupled to each other is set to λ/4, and therefore, an electric length of the folded antenna is set to λ/2, and the folded antenna resonates at the frequency f. Thus, the feed element 21 and the parasitic element 22 resonate at the frequency f corresponding to the wavelength λ determined by the sum of the electric length L20 of the feed element 21 and the electric length L20 of the parasitic element 22.

The feed element 21 and the parasitic element 22 may be arranged to overlap each other, at at least a portion including the open end 21*d* of the feed element 21 and the open end 22*d* of the parasitic element 22.

Now, the antenna 3 is explained.

The antenna 3 is provided with: a dielectric substrate 30, a feed element 31 having a strip shape and formed on the front side of the dielectric substrate 30 (FIG. 4), and a parasitic element 32 having a strip shape and formed on the back side of the dielectric substrate 30 (FIG. 5). The feed element 31 and the parasitic element 32 are made of conductive foil, such as copper or silver. The dielectric substrate 30, the feed element 31, and the parasitic element 32 are configured as, e.g., a printed-circuit board having conductor layers on both sides.

As shown in FIGS. 4 and 5, the feed element 31 and the parasitic element 32 may be to be of, e.g., an inverted-L type. Referring to FIG. 4, the feed element 31 includes element parts 31*a* and 31*b*, which are connected to each other at a connecting point 31*c*. The element part 31*a* extends substantially toward the +Y direction from a position close to the ground conductor plate 104. The element part 31*a* is connected to a feeding point 33 at one end of the element part 31*a*, and connected to the element part 31*b* at the connecting point 31*c* of the other end of the element part 31*a*. The element part 31*b* extends substantially toward the +X direction from the connecting point 31*c*. The element part 31*b* is opened at an open end 31*d* of one end of the element part 31*b*, and connected to the element part 31*a* at the connecting point 31*c* of the other end of the element part 31*b*. Referring to FIG. 5, the parasitic element 32 includes element parts 32*a* and 32*b*, which are connected to each other at a connecting point 32*c*. The element part 32*a* extends substantially toward the +Y direction from a position close to the ground conductor plate 104. The element part 32*a* is connected to a connecting conductor 34 at a connecting point 34*a* located at one end of the element part 32*a*, and grounded to an edge of the ground conductor plate 104 through the connecting conductor 34. The element part 32*a* is connected to the element part 32*b* at the connecting point 32*c* of the other end of the element part 32*a*. The element part 32*b* extends substantially toward the +X direction from the connecting point 32*c*. The element part 32*b* is opened at an open end 32*d* of one end of the element part 32*b*, and connected to the element part 32*a* at the connecting point 32*c* of the other end of the element part 32*b*.

As described above, the feed element 31 has the end connected to the feeding point 33 (first end), and the open end 31*d* (second end). The parasitic element 32 has the end connected to the ground conductor plate 104 (first end), and the open end 32*d* (second end). The feed element 31 and the parasitic element 32 are arranged to oppose each other, at at least a portion including the open end 31*d* of the feed element 31 and the open end 32*d* of the parasitic element 32.

The feed element 31 and the parasitic element 32 may be arranged to be capacitively coupled to each other, at at least a portion including the open end 31*d* of the feed element 31 and the open end 32*d* of the parasitic element 32. In this case, since the open end 31*d* of the feed element 31 and the open end 32*d* of the parasitic element 32 are capacitively coupled to each other, the antenna 3 operates as a folded antenna including the feed element 31 and the parasitic element 32, and being folded at the open ends 31*d* and 32*d*. An electric length L30 of each of the feed element 31 and the parasitic element 32 capacitively coupled to each other is set to $\lambda/4$, and therefore, an electric length of the folded antenna is set to $\lambda/2$, and the folded antenna resonates at the frequency f. Thus, the feed element 31 and the parasitic element 32 resonate at the frequency f corresponding to the wavelength $\lambda$ determined by the sum of the electric length L30 of the feed element 31 and the electric length L30 of the parasitic element 32.

The feed element 31 and the parasitic element 32 may be arranged to overlap each other, at at least a portion including the open end 31*d* of the feed element 31 and the open end 32*d* of the parasitic element 32.

Now, the antenna 4 is explained.

Referring to FIGS. 4 and 5, the antenna 4 is a monopole antenna provided with a feed element 41 having a strip shape, and the antenna 4 is connected to a feeding point 43. The feed element 41 may be projected from the housing of the electronic apparatus 100 in the −X direction or any other direction. The electric length L40 of the feed element 41 is set to $\lambda/4$, and the antenna 4 resonates at the frequency f.

As described above, the antenna apparatus 107 is provided with the feeding points 13, 23, 33, and 43, and the antennas 1 to 4 connected to the respective feeding points. The antennas 1 to 4 are respectively connected to the wireless receiving circuit of the main circuit board 103 through feed lines each having an impedance of, e.g., 50 ohms. The wireless receiving circuit receives radio signals having the frequency f using the antennas 1 to 4.

At least one of the antennas 1 to 4 may have a different polarization direction from the other antennas. Therefore, for example, the antennas 1 to 4 are arranged as follows. The antenna 1 is provided close to an edge on the +X side of the ground conductor plate 104, and the feeding point 13 is provided close to a corner at the +X side and +Y side of the ground conductor plate 104. The antenna 2 is provided close to an edge on the +Y side of the ground conductor plate 104, and the feeding point 23 is provided close to the corner at the +X side and +Y side of the ground conductor plate 104. The antenna 3 is provided close to the edge on the +Y side of the ground conductor plate 104, and the feeding point 33 is provided close to a corner at the −X side and +Y side of the ground conductor plate 104. The antenna 4 is provided close to the corner at the −X side and the +Y side of the ground conductor plate 104, and the feeding point 43 is provided close to the corner at the −X side and the +Y side of the ground conductor plate 104. The antenna 1 receives a vertically-polarized radio wave having a polarization direction parallel to the X axis. The antenna 2 receives a vertically-polarized radio wave having a polarization direction parallel to the Y axis. The antenna 3 receives a vertically-polarized radio wave having a polarization direction parallel to the Y axis. The antenna 4 receives a horizontally-polarized radio wave.

For performing the polarization diversity processing, the antennas 1 to 4 are configured to have the same resonance frequency with each other. The antennas 1 to 3 may have different sizes from each other, in order to obtain the same resonance frequency, taking into consideration the influences from other components of the electronic apparatus 100.

[1-2. Operation]

Now, an operation of the antenna apparatus 107 configured as mentioned above is explained.

Figure 6:
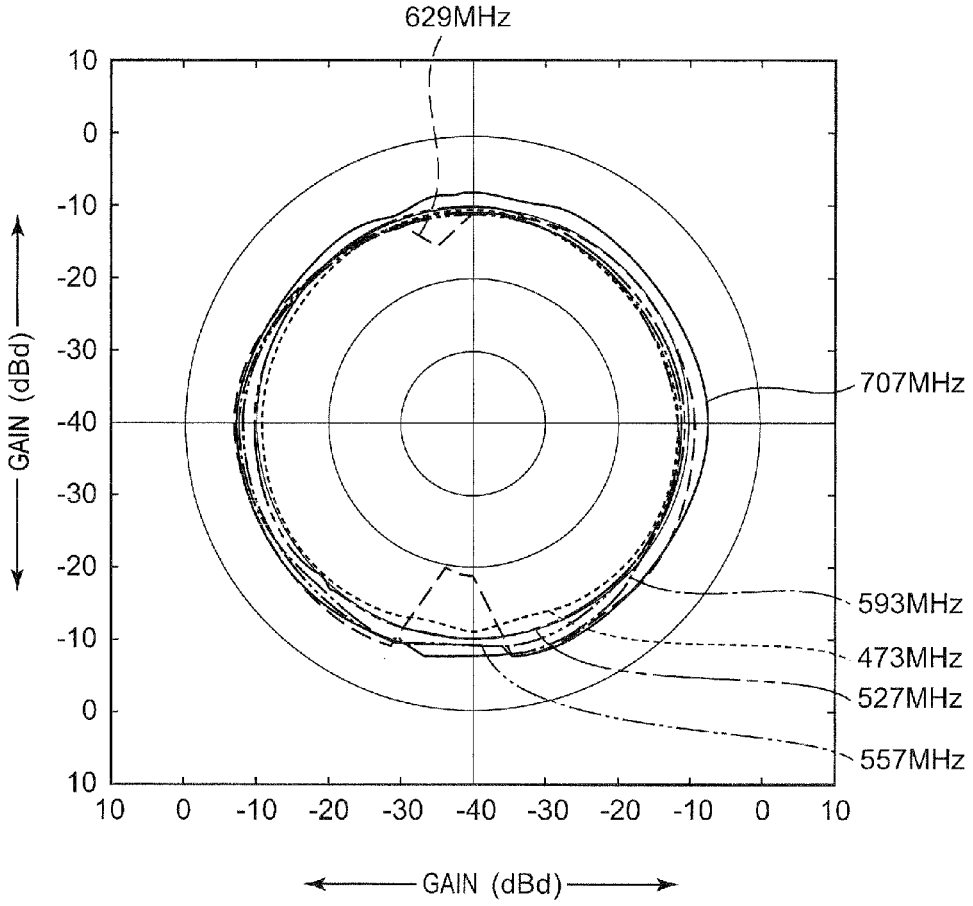
FIG. 6 is a radiation pattern diagram of a vertically-polarized radio wave of an antenna 1 of FIG. 2.
Figure 7:
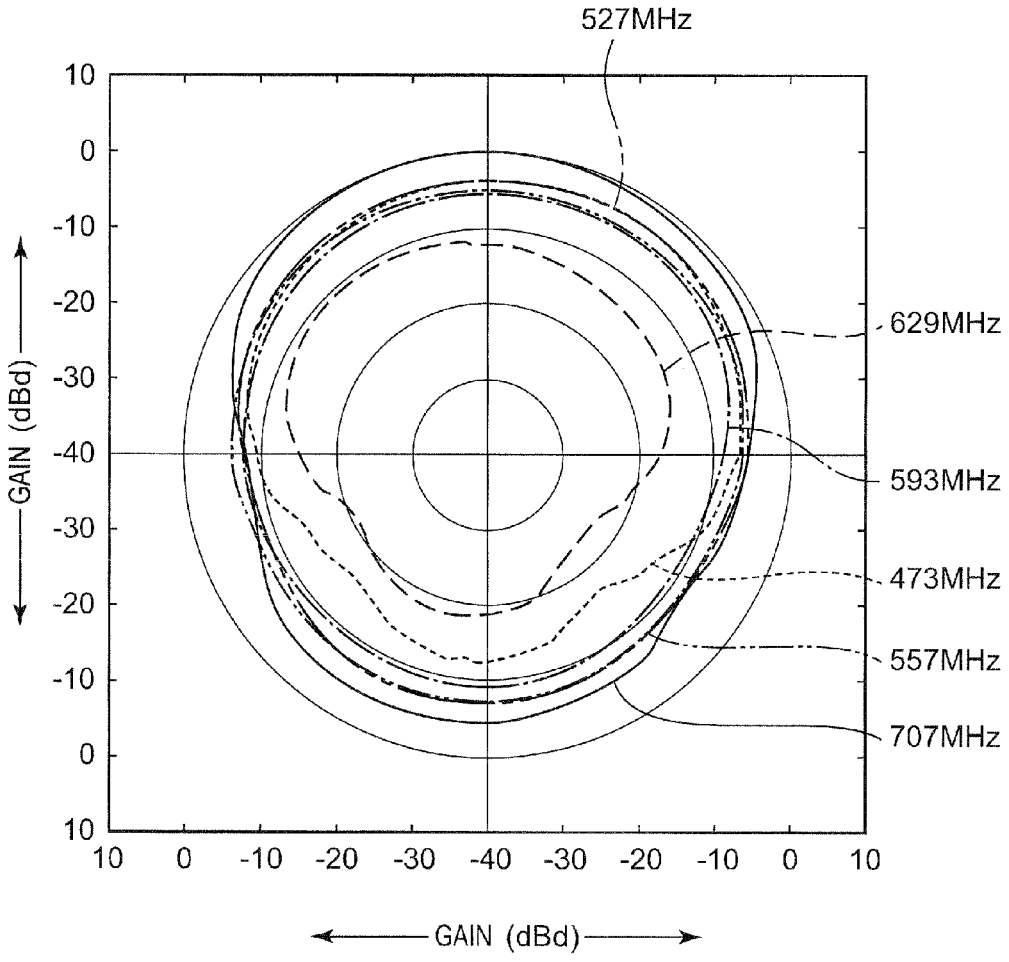
FIG. 7 is a radiation pattern diagram of a vertically-polarized radio wave of an antenna 2 of FIG. 2.
Figure 8:
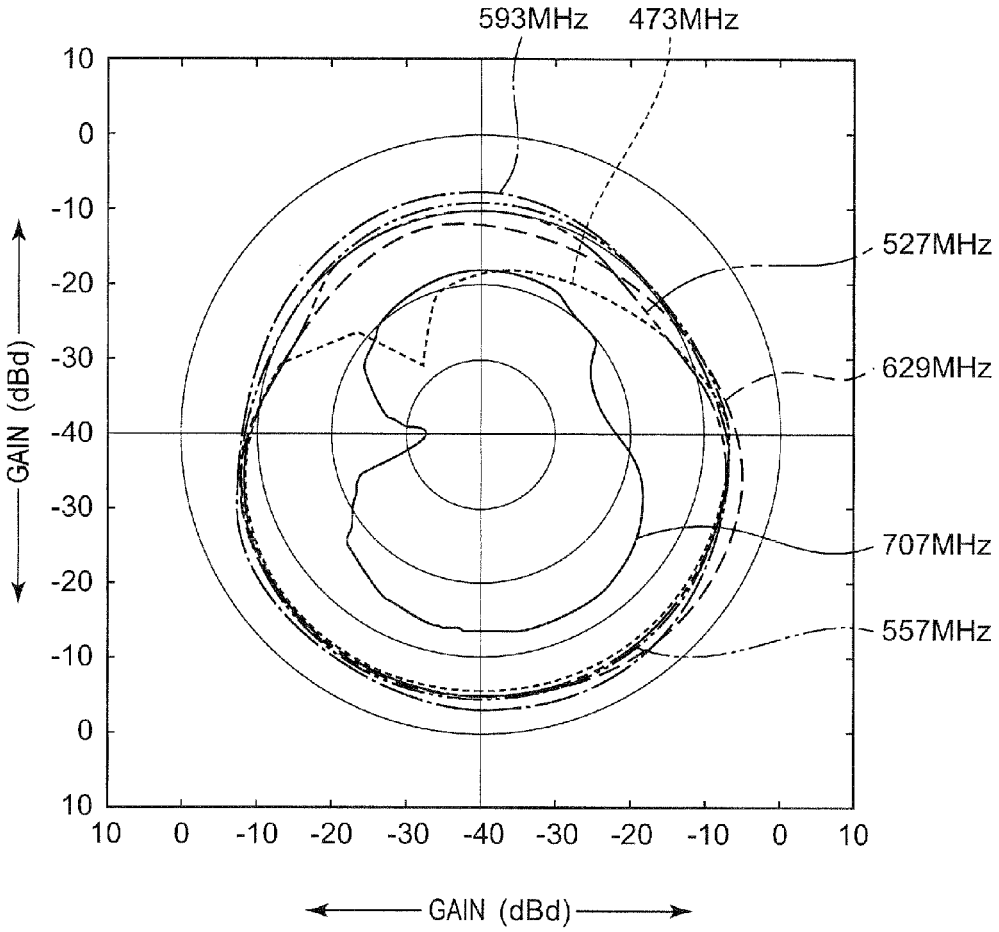
FIG. 8 is a radiation pattern diagram of a vertically-polarized radio wave of an antenna 3 of FIG. 2.
Figure 9:
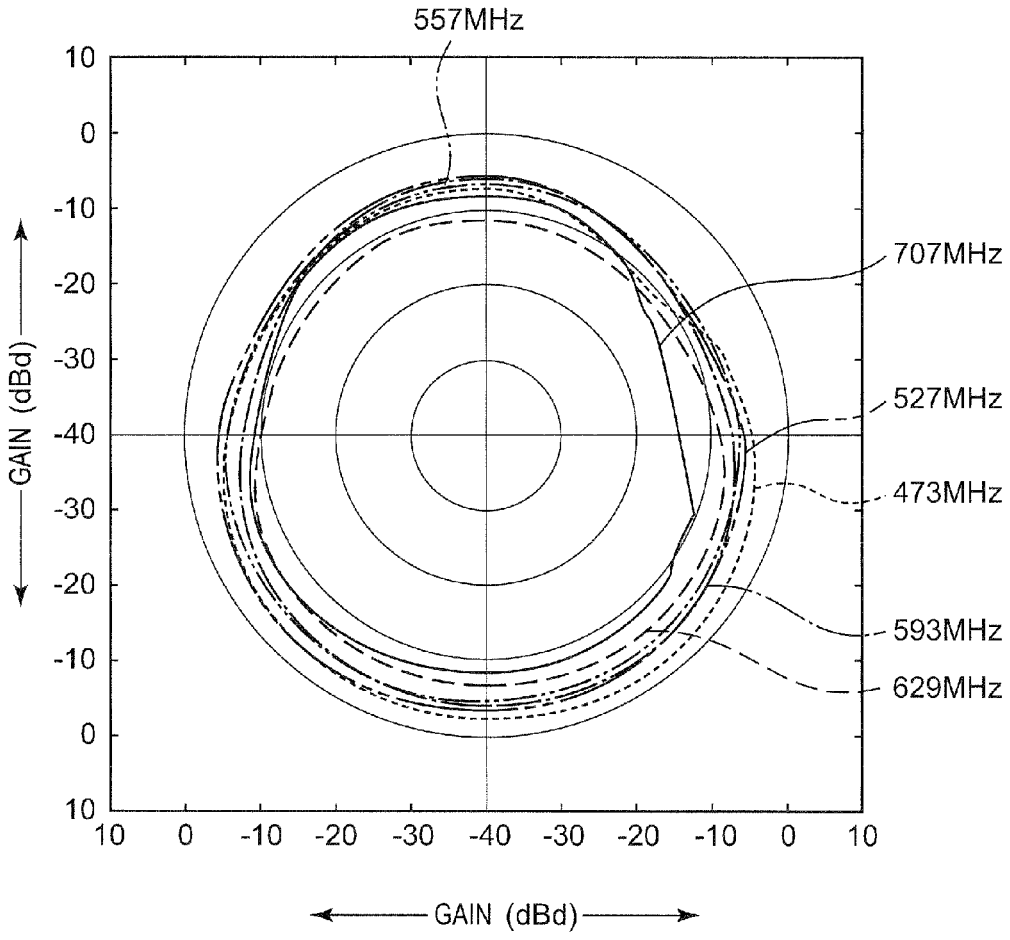
FIG. 9 is a radiation pattern diagram of a vertically-polarized radio wave of an antenna 4 of FIG. 2.
Figure 10:
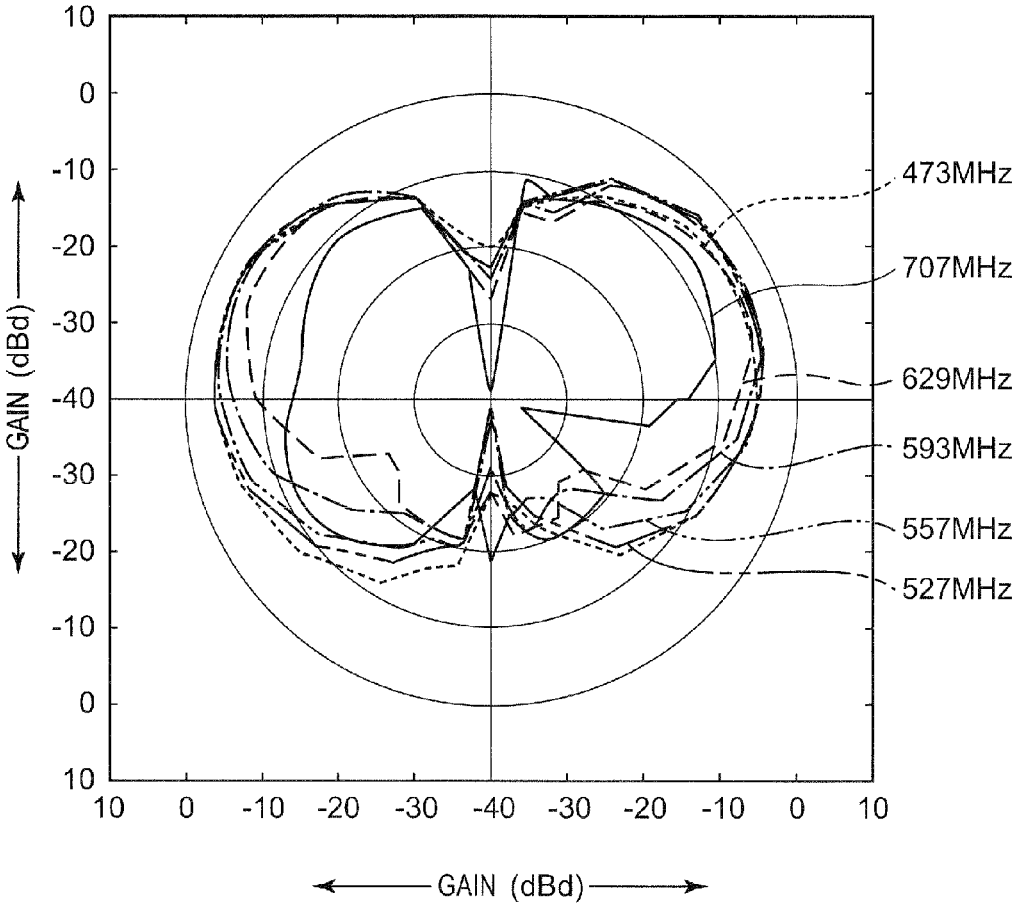
FIG. 10 is a radiation pattern diagram of a horizontally-polarized radio wave of the antenna 1 of FIG. 2.
Figure 11:
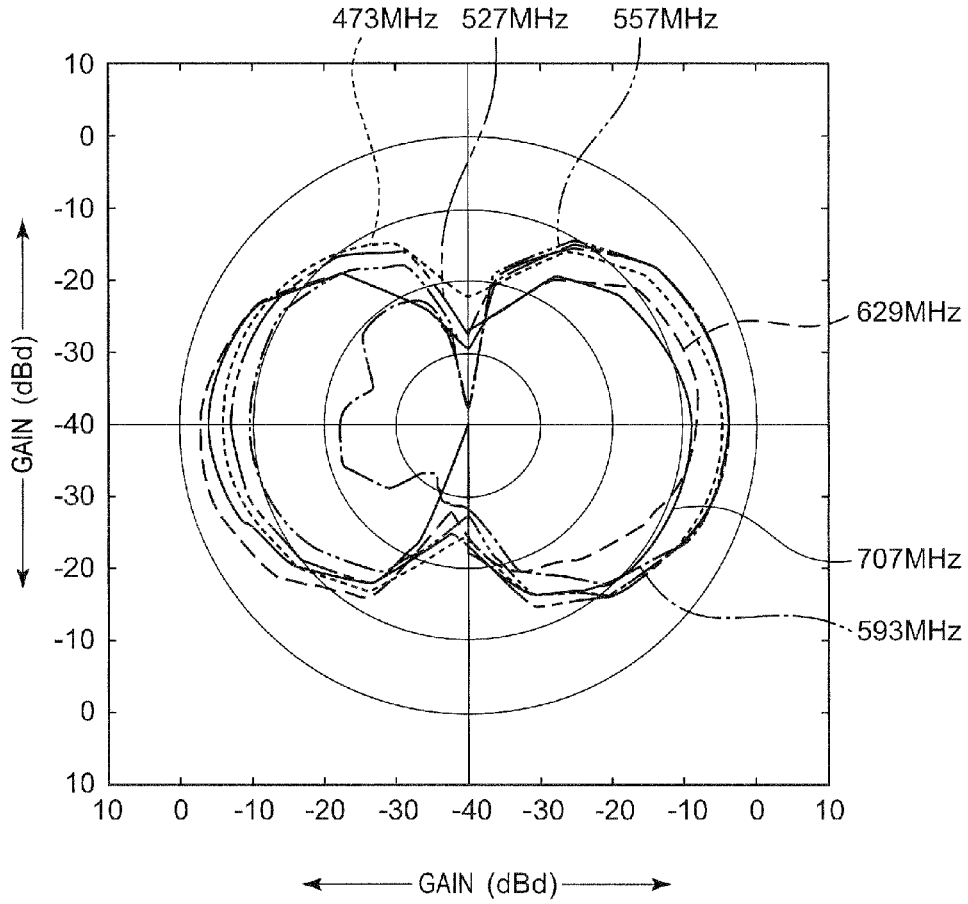
FIG. 11 is a radiation pattern diagram of a horizontally-polarized radio wave of the antenna 2 of FIG. 2.
Figure 12:
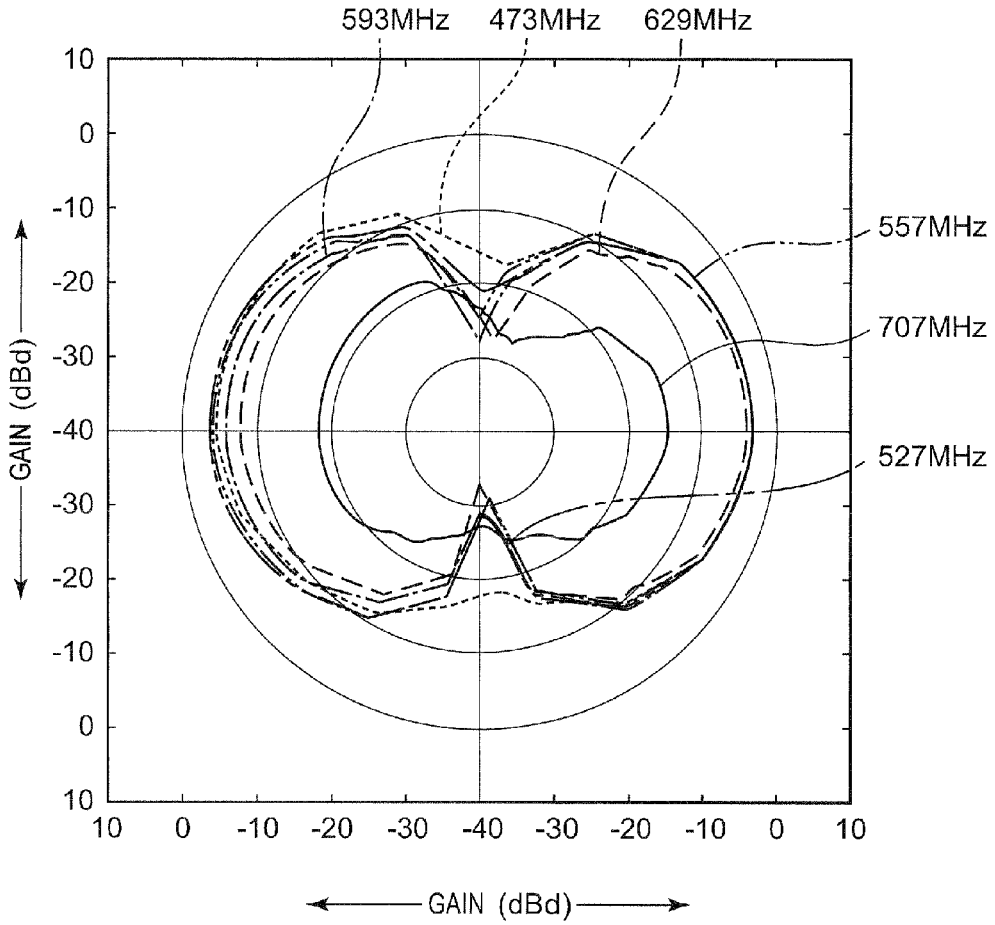
FIG. 12 is a radiation pattern diagram of a horizontally-polarized radio wave of the antenna 3 of FIG. 2.
Figure 13:
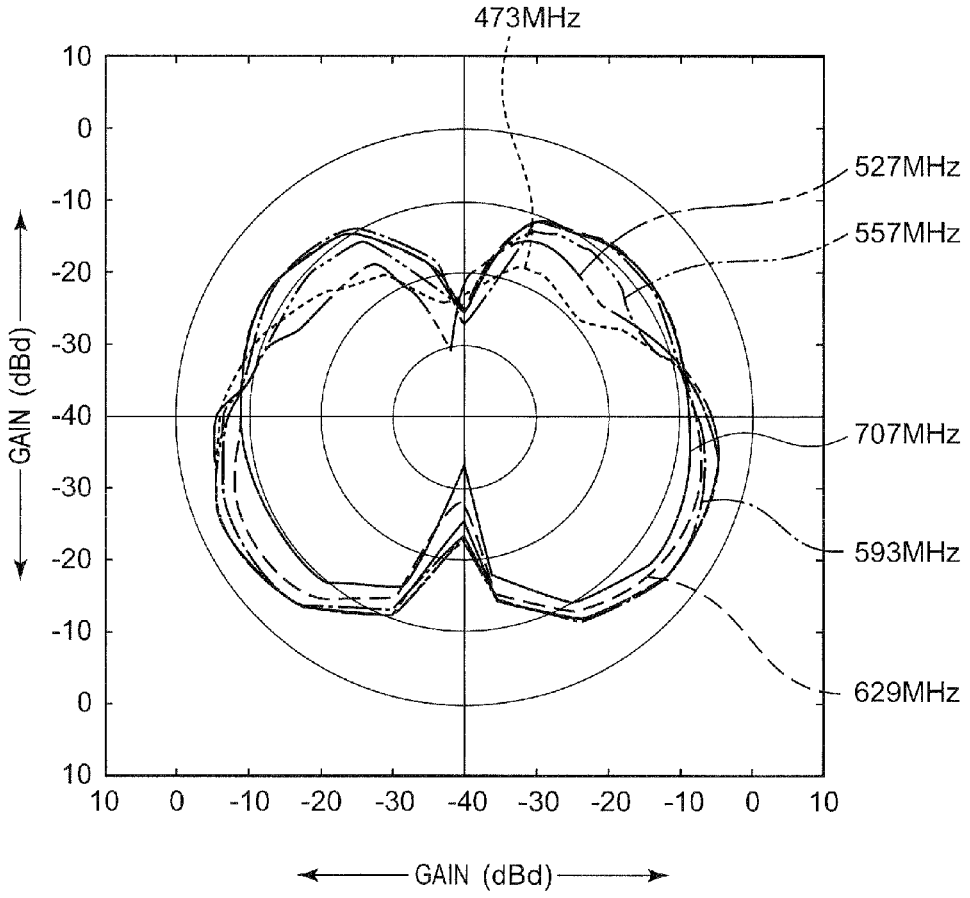
FIG. 13 is a radiation pattern diagram of a horizontally-polarized radio wave of the antenna 4 of FIG. 2.

FIG. 6 is a radiation pattern diagram of a vertically-polarized radio wave of the antenna 1 of FIG. 2. FIG. 7 is a radiation pattern diagram of a vertically-polarized radio wave of the antenna 2 of FIG. 2. FIG. 8 is a radiation pattern diagram of a vertically-polarized radio wave of the antenna 3 of FIG. 2. FIG. 9 is a radiation pattern diagram of a vertically-polarized radio wave of the antenna 4 of FIG. 2. FIG. 10 is a radiation pattern diagram of a horizontally-polarized radio wave of the antenna 1 of FIG. 2. FIG. 11 is a radiation pattern diagram of a horizontally-polarized radio wave of the antenna 2 of FIG. 2. FIG. 12 is a radiation pattern diagram of a horizontally-polarized radio wave of the antenna 3 of FIG. 2. FIG. 13 is a radiation pattern diagram of a horizontally-polarized radio wave of the antenna 4 of FIG. 2. As shown in FIGS. 6 to 9, the antennas 1 to 4 are substantially omnidirectional for vertically-polarized radio waves over the entire frequency band of the terrestrial digital television broadcast.

Figure 14:
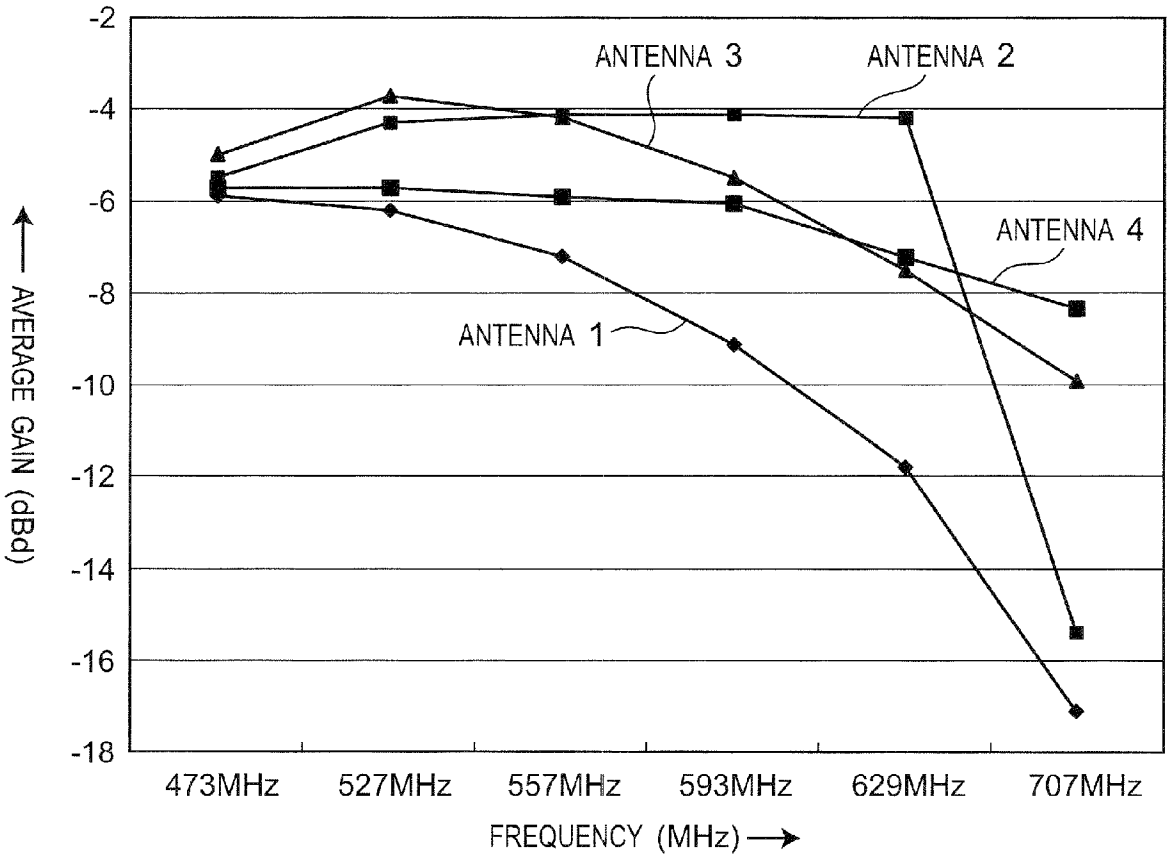
FIG. 14 is a graph showing average gain versus frequency characteristics for the antennas 1 to 4 of FIG. 2.

FIG. 14 is a graph showing average gain versus frequency characteristics for the antennas 1 to 4 of FIG. 2. The vertical axis of the graph shows an average gain under a cross polarization of −6 dB ("a gain of horizontal polarization"+ ("a gain of vertical polarization"−6)). As shown in FIG. 14, an average of the average gains of the antennas 1 to 4 was −7.9 dBd or more at respective frequencies of the terrestrial digital television broadcast.

[1-3. Advantageous Effects, etc.]

As described above, the antenna apparatus 107 of the embodiment is provided with the antennas 1 to 4 and the ground conductor plate 104, and the antennas 1 to 3 are configured as follows.

The antenna 1 is provided with: the dielectric substrate 10, the feed element 11 having the strip shape and formed on the front side of the dielectric substrate 10, and the parasitic element 12 having the strip shape and formed on the back side of the dielectric substrate 10. The feed element 11 has the end connected to the feeding point 13 (first end), and the open end 11*d* (second end). The parasitic element 12 has the end connected to the ground conductor plate 104 (first end), and the open end 12*d* (second end). The feed element 11 and the parasitic element 12 are arranged to oppose each other, at at least a portion including the open end 11*d* of the feed element 11 and the open end 12*d* of the parasitic element 12.

The feed element 11 and the parasitic element 12 may be arranged to be capacitively coupled to each other, at at least a portion including the open end 11*d* of the feed element 11 and the open end 12*d* of the parasitic element 12. In this case, the feed element 11 and the parasitic element 12 resonate at the frequency f corresponding to the wavelength λ determined by the sum of the electric length L10 of the feed element 11 and the electric length L10 of the parasitic element 12.

The antenna 2 is provided with: the dielectric substrate 20, the feed element 21 having the strip shape and formed on the front side of the dielectric substrate 20, and the parasitic element 22 having the strip shape and formed on the back side of the dielectric substrate 20. The feed element 21 has the end connected to the feeding point 23 (first end), and the open end 21*d* (second end). The parasitic element 22 has the end connected to the ground conductor plate 104 (first end), and the open end 22*d* (second end). The feed element 21 and the parasitic element 22 are arranged to oppose each other, at at least a portion including the open end 21*d* of the feed element 21 and the open end 22*d* of the parasitic element 22. The feed element 21 and the parasitic element 22 may be arranged to be capacitively coupled to each other, at at least a portion including the open end 21*d* of the feed element 21 and the open end 22*d* of the parasitic element 22. In this case, the feed element 21 and the parasitic element 22 resonate at the frequency f corresponding to the wavelength λ determined by the sum of the electric length L20 of the feed element 21 and the electric length L20 of the parasitic element 22.

The antenna 3 is provided with: the dielectric substrate 30, the feed element 31 having the strip shape and formed on the front side of the dielectric substrate 30, and the parasitic element 32 having the strip shape and formed on the back side of the dielectric substrate 30. The feed element 31 has the end connected to the feeding point 33 (first end), and the open end 31*d* (second end). The parasitic element 32 has the end connected to the ground conductor plate 104 (first end), and the open end 32*d* (second end). The feed element 31 and the parasitic element 32 are arranged to oppose each other, at at least a portion including the open end 31*d* of the feed element 31 and the open end 32*d* of the parasitic element 32. The feed element 31 and the parasitic element 32 may be arranged to be capacitively coupled to each other, at at least a portion including the open end 31*d* of the feed element 31 and the open end 32*d* of the parasitic element 32. In this case, the feed element 31 and the parasitic element 32 resonate at the frequency f corresponding to the wavelength λ determined by the sum of the electric length L30 of the feed element 31 and the electric length L30 of the parasitic element 32.

Thus, the antennas 1 to 3 can achieve wide band operation by using capacitive coupling between the feed elements and the parasitic elements, and using resonance of the ground conductor plate 104 due to the current flowing in the ground conductor plate 104. It is possible to reduce the decreases in the gain and in the bandwidth by using the antennas 1 to 3, as the inverted-L folded antennas each using the parallel resonance between a feed element and a parasitic element.

In addition, when the antennas 1 and 2 are provided adjacent to each other as shown in FIGS. 4 and 5, the antenna 1 receives a horizontally-polarized radio wave, and the antenna 2 receives a vertically-polarized radio wave. Therefore, the direction of a ground current resulting from the receiving operation of the antenna 1 is perpendicular to the direction of a ground current resulting from the receiving operation of the antenna 2. As a result, it is possible to increase the isolation between the antennas 1 and 2, and therefore, substantially prevent the decrease in the gain.

In addition, a distance between the feeding point 23 of the antenna 2 and the feeding point 33 of the antenna 3 is set to λ/4 or more. Therefore, when a ground current resulting from the receiving operation of the antenna 2 is flowing, no ground current resulting from the receiving operation of the antenna 3 flows. As a result, it is possible to increase the isolation between the antennas 2 and 3, and therefore, substantially prevent the decrease in the gain.

In addition, the antenna 3 receives a vertically-polarized radio wave, and the antenna 4 receives a horizontally-polarized radio wave. Therefore, it is possible to increase the isolation between the antennas 3 and 4, as compared with that of case where the antennas 3 and 4 receive radio waves having the same polarization direction, and therefore, it is possible to substantially prevent the decrease in the gain.

In addition, according to the antenna apparatus of the first embodiment, it is possible to reduce the size of the electronic apparatus 100, since the antennas 1 to 4 can be provided close to the ground conductor plate 104. In addition, it is possible to provide the electronic apparatus 100 which is inexpensive and highly water-resistant, since no housing is needed other than the housing of the electronic apparatus 100 itself to install the antenna apparatus provided with the antennas 1 to 4. In addition, since the antennas 1 to 3 can be arranged at the chamfered portions of the back cover 105, it is possible to emphasize the thinness in the appearance of the electronic apparatus 100, and strengthen the structure of its housing.

2. Second Embodiment

Hereinafter, a second embodiment is described with reference to FIGS. 15 to 19.

[2-1. Configuration]

Figure 15:
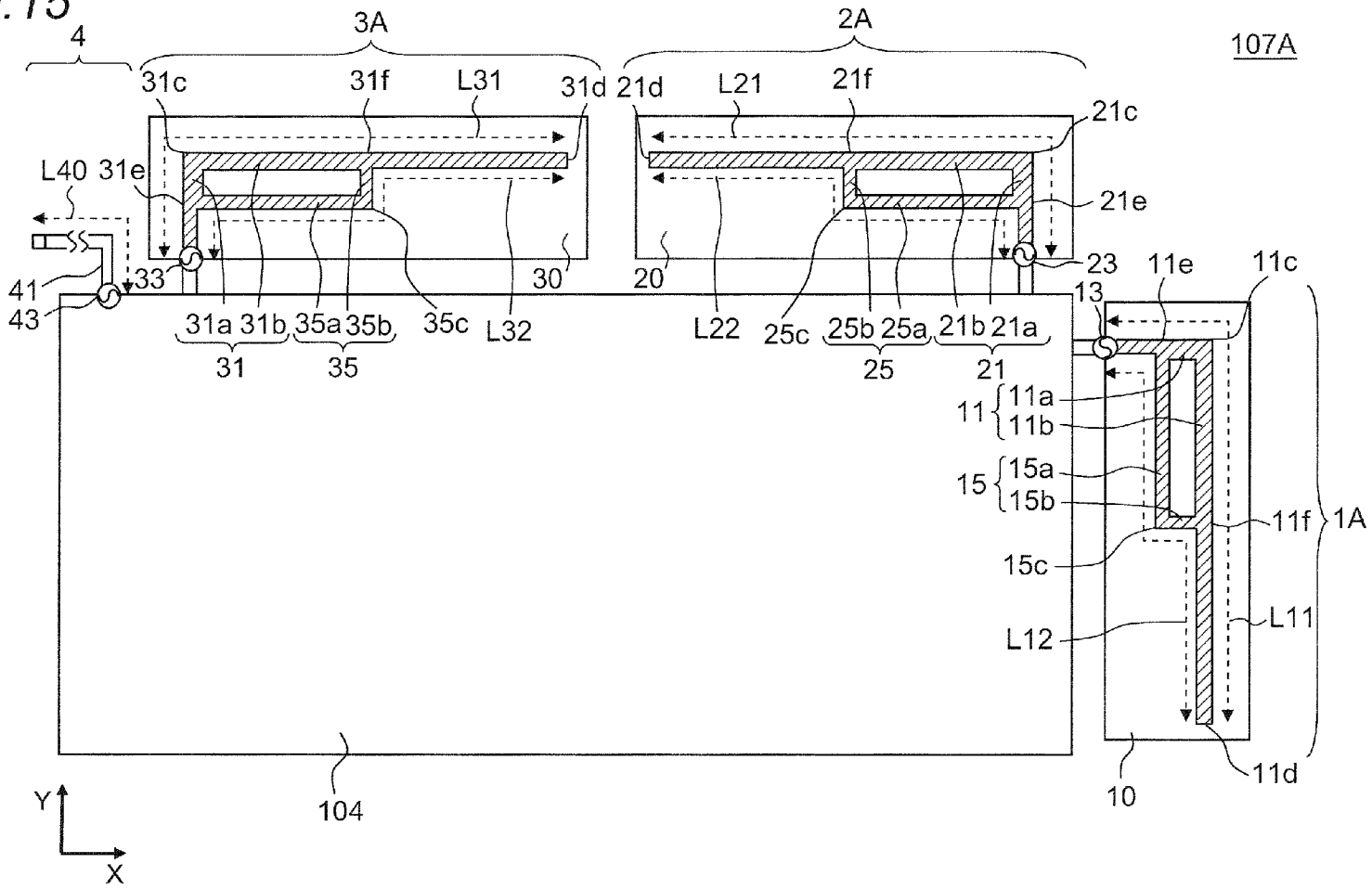
FIG. 15 is a plan view of an antenna apparatus 107A according to a second embodiment, seen from a front side thereof.
Figure 16:
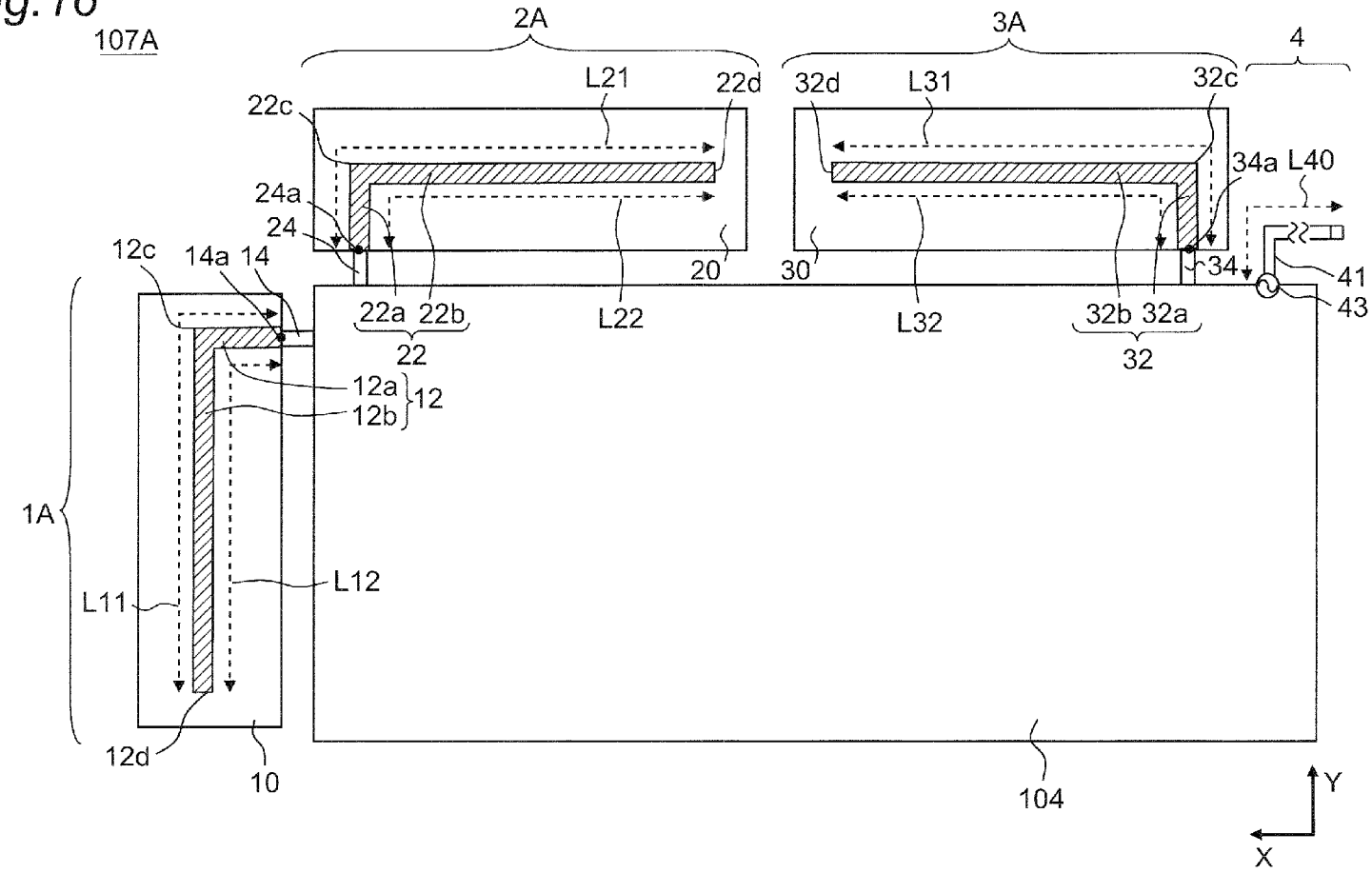
FIG. 16 is a plan view of the antenna apparatus 107A of FIG. 15, seen from a back side thereof.

An electronic apparatus 100 of the second embodiment is provided with an antenna apparatus 100A shown in FIGS. 15 and 16, in place of the antenna apparatus 107 of FIG. 1. The antenna apparatus 107A is provided with: antennas 1A, 2A, 3A and 4 formed on dielectric substrates 10, 20, and 30, respectively; and a ground conductor plate 104. λ1 denotes a first wavelength corresponding to a first frequency "f" within an operating band of the electronic apparatus 100, and λ2 denotes a second wavelength corresponding to a second frequency "f" within the operating band. Since the other portions of the electronic apparatus 100 of the second embodiment are configured in the same manner as that of the first embodiment, their explanations are omitted.

FIG. 15 is a plan view of the antenna apparatus 107A according to the second embodiment, seen from a front side thereof. FIG. 16 is a plan view of the antenna apparatus 107A of FIG. 15, seen from a back side thereof.

First, the antenna 1A is explained.

The antenna 1A is provided with a dielectric substrate 10, a feed element (first feed element) 11, and a parasitic element 12, which are similar to those of the antenna 1 of the first embodiment. The antenna 1A is further provided with a second feed element 15 having a strip shape and formed on the front side of the dielectric substrate 10 (FIG. 15). The feed element 15 is made of conductive foil, such as copper or silver. The dielectric substrate 10, the feed elements 11, 15, and the parasitic element 12 are configured as, e.g., a printed-circuit board having conductor layers on both sides.

The feed element 15 has a first end and a second end, the first and second ends being connected to connecting points 11*e* and 11*f* at different positions on the feed element 11, respectively. Referring to FIG. 15, the feed element 15 includes element parts 15*a* and 15*b*, which are connected to each other at a connecting point 15*c*. The element part 15*a* extends substantially toward the −Y direction from an element part 11*a* of the feed element 11. The element part 15*a* is connected to the element part 11*a* of the feed element 11 at the connecting point 11*e* located at one end of the element part 15*a*, and connected to the element part 15*b* at the connecting point 15*c* of the other end of the element part 15*a*. The element part 15*b* extends substantially toward the +X direction from the connecting point 15*c*. The element part 15*b* is connected to an element part 11*b* of the feed element 11 at the connecting point 11*f* located at one end of the element part 15*b*, and connected to the element part 15*a* at the connecting point 15*c* of the other end of the element part 15*b*.

Figure 17:
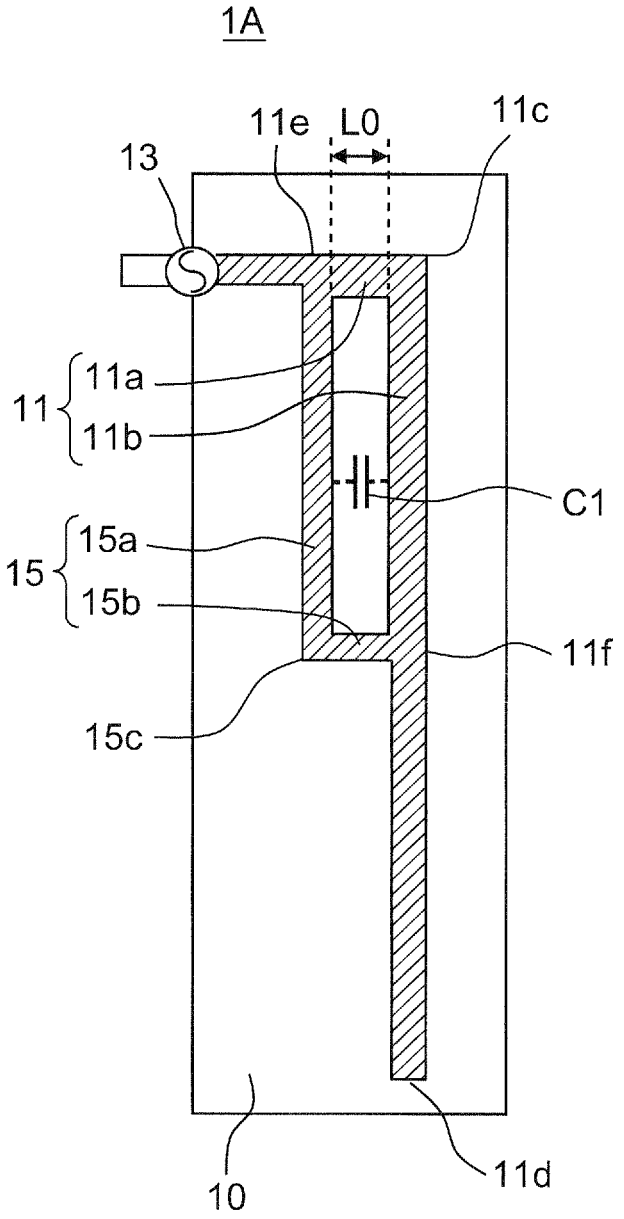
FIG. 17 is an enlarged view of an antenna 1A of FIG. 15.

The feed element 15 is arranged to be capacitively coupled to the feed element 11, at at least a portion between the first end (connecting point 11*e*) and the second end (connecting point 11*f*) of the feed element 15. FIG. 17 is an enlarged view of the antenna 1A of FIG. 15. The feed elements 11 and 15 are arranged in parallel with a distance L0 (e.g., a distance approximately equal to each width of the feed elements 11 and 15), and therefore, a virtual capacitor C1 appears between them. Since the virtual capacitor C1 is formed between the feed elements 11 and 15, a physical length of the feed elements 11 and 15 is shortened at a frequency determined by a capacitance of the capacitor C1.

When an open end 11*d* of the feed element 11 and an open end 12*d* of the parasitic element 12 are capacitively coupled to each other, the antenna 1A operates as a first folded antenna including the feed element 11 and the parasitic element 12, and being folded at the open ends 11*d* and 12*d*. An electric length L11 of each of the feed element 11 and the parasitic element 12 capacitively coupled to each other is set to λ1/4, and therefore, an electric length of the first folded antenna is set to λ1/2, and the first folded antenna resonates at the frequency f1. Thus, the feed element 11 and the parasitic element 12 resonate at the first frequency f1 corresponding to the first wavelength determined by the sum of the electric length L11 of the feed element 11 and the electric length L11 of the parasitic element 12.

When the open end 11*d* of the feed element 11 and the open end 12*d* of the parasitic element 12 are capacitively coupled to each other, the antenna 1A further operates as a second folded antenna, the second folded antenna including a portion of the feed element 11 from a feeding point 13 to the connecting point 11*e*, the feed element 15, a portion of the feed element 11 from the connecting point 11*f* to the open end 11*d*, and the parasitic element 12, and the second folded antenna being folded at the open ends 11*d* and 12*d*. An electric length L12 of the portion of the feed element 11 from the feeding point 13 to the connecting point 11*e*, the feed element 15, and the portion of the feed element 11 from the connecting point 11*f* to the open end 11*d*, when these portions are capacitively coupled to the parasitic element 12, is set to λ2/4. An electric length L12 of the parasitic element 12, when the parasitic element 12 is capacitively coupled to the feed elements 11 and 15, is set to λ2/4. Therefore, an electric length of the second folded antenna is set to λ2/2, and the second folded antenna resonates at a frequency f2. Thus, the feed element 11, the feed element 15, and the parasitic element 12 resonate at the second frequency f2 corresponding to the second wavelength λ2 determined by the sum of the electric length L12 of the feed elements 11 and 15 and the electric length L12 of the parasitic element 12.

The feed element 15 and the parasitic element 12 may be arranged to oppose each other, at at least a portion thereof. In addition, the feed element 15 and the parasitic element 12 may be arranged to be capacitively coupled to each other, at at least a portion thereof. In addition, the feed element 15 and the parasitic element 12 may be arranged to overlap each other, at at least a portion thereof.

Now, the antenna 2A is explained.

The antenna 2A is provided with a dielectric substrate 20, a feed element (first feed element) 21, and a parasitic element 22, which are similar to those of the antenna 2 of the first embodiment. The antenna 2A is further provided with a second feed element 25 having a strip shape and formed on the front side of the dielectric substrate 20 (FIG. 15). The feed element 25 is made of conductive foil, such as copper or silver. The dielectric substrate 20, the feed elements 21, 25, and the parasitic element 22 are configured as, e.g., a printed-circuit board having conductor layers on both sides.

The feed element 25 has a first end and a second end, the first and second ends being connected to connecting points 21*e* and 21*f* at different positions on the feed element 21, respectively. Referring to FIG. 15, the feed element 25 includes element parts 25*a* and 25*b*, which are connected to each other at a connecting point 25*c*. The element part 25*a* extends substantially toward the −X direction from an element part 21*a* of the feed element 21. The element part 25*a* is connected to the element part 21*a* of the feed element 21 at the connecting point 21*e* located at one end of the element part 25*a*, and connected to the element part 25*b* at the connecting point 25*c* of the other end of the element part 25*a*. The element part 25*b* extends substantially toward the +Y direction from the connecting point 25*c*. The element part 25*b* is connected to an element part 21*b* of the feed element 21 at the connecting point 21*f* located at one end of the element part 25*b*, and connected to the element part 25*a* at the connecting point 25*c* of the other end of the element part 25*b*.

The feed element 25 is arranged to be capacitively coupled to the feed element 21, at at least a portion between the first end (connecting point 21*e*) and the second end (connecting point 21*f*) of the feed element 25. The feed elements 21 and 25 are arranged in parallel with a certain distance (e.g., a distance approximately equal to each width of the feed elements 21 and 25), and therefore, a virtual capacitor appears between them. Since the virtual capacitor is formed between the feed elements 21 and 25, a physical length of the feed elements 21 and 25 is shortened at a frequency determined by a capacitance of the capacitor.

When an open end 21*d* of the feed element 21 and an open end 22*d* of the parasitic element 22 are capacitively coupled to each other, the antenna 2A operates as a first folded antenna including the feed element 21 and the parasitic element 22, and being folded at the open ends 21*d* and 22*d*. An electric length L21 of each of the feed element 21 and the parasitic element 22 capacitively coupled to each other is set to λ1/4, and therefore, an electric length of the first folded antenna is set to λ1/2, and the first folded antenna resonates at the frequency f1. Thus, the feed element 21 and the parasitic element 22 resonate at the first frequency f1 corresponding to the first wavelength λ1 determined by the sum of the electric length L21 of the feed element 21 and the electric length L21 of the parasitic element 22.

When the open end 21*d* of the feed element 21 and the open end 22*d* of the parasitic element 22 are capacitively coupled to each other, the antenna 2A further operates as a second folded antenna, the second folded antenna including a portion of the feed element 21 from a feeding point 23 to the connecting point 21*e*, the feed element 25, a portion of the feed element 21 from the connecting point 21*f* to the open end 21*d*, and the parasitic element 22, and the second folded antenna being folded at the open ends 21*d* and 22*d*. An electric length L22 of the portion of the feed element 21 from the feeding point 23 to the connecting point 21*e*, the feed element 25, and the portion of the feed element 21 from the connecting point 21*f* to the open end 21*d*, when these portions are capacitively coupled to the parasitic element 22, is set to λ2/4. An electric length L22 of the parasitic element 22, when the parasitic element 22 is capacitively coupled to the feed elements 21 and 25, is set to λ2/4. Therefore, an electric length of the second folded antenna is set to λ2/2, and the second folded antenna resonates at a frequency f2. Thus, the feed element 21, the feed element 25, and the parasitic element 22 resonate at the second frequency f2 corresponding to the second wavelength λ2 determined by the sum of the electric length L22 of the feed elements 21 and 25 and the electric length L22 of the parasitic element 22.

The feed element 25 and the parasitic element 22 may be arranged to oppose each other, at at least a portion thereof. In addition, the feed element 25 and the parasitic element 22 may be arranged to be capacitively coupled to each other, at at least a portion thereof. In addition, the feed element 25 and the parasitic element 22 may be arranged to overlap each other, at at least a portion thereof.

Now, the antenna 3A is explained.

The antenna 3A is provided with a dielectric substrate 30, a feed element (first feed element) 31, and a parasitic element 32, which are similar to those of the antenna 3 of the first embodiment. The antenna 3A is further provided with a second feed element 35 having a strip shape and formed on the front side of the dielectric substrate 30 (FIG. 15). The feed element 35 is made of conductive foil, such as copper or silver. The dielectric substrate 30, the feed elements 31, 35, and the parasitic element 32 are configured as, e.g., a printed-circuit board having conductor layers on both sides.

The feed element 35 has a first end and a second end, the first and second ends being connected to connecting points 31*e* and 31*f* at different positions on the feed element 31, respectively. Referring to FIG. 15, the feed element 35 includes element parts 35*a* and 35*b*, which are connected to each other at a connecting point 35*c*. The element part 35*a* extends substantially toward the +X direction from an element part 31*a* of the feed element 31. The element part 35*a* is connected to the element part 31*a* of the feed element 31 at the connecting point 31*e* located at one end of the element part 35*a*, and connected to the element part 35*b* at the connecting point 35*c* of the other end of the element part 35*a*. The element part 35*b* extends substantially toward the +Y direction from the connecting point 35*c*. The element part 35*b* is connected to an element part 31*b* of the feed element 31 at the connecting point 31*f* located at one end of the element part 35*b*, and connected to the element part 35*a* at the connecting point 35*c* of the other end of the element part 35*b*.

The feed element 35 is arranged to be capacitively coupled to the feed element 31, at at least a portion between the first end (connecting point 31*e*) and the second end (connecting point 31*f*) of the feed element 35. The feed elements 31 and 35 are arranged in parallel with a certain distance (e.g., a distance approximately equal to each width of the feed elements 31 and 35), and therefore, a virtual capacitor appears between them. Since the virtual capacitor is formed between the feed elements 31 and 35, a physical length of the feed elements 31 and 35 is shortened at a frequency determined by a capacitance of the capacitor.

When an open end 31*d* of the feed element 31 and an open end 32*d* of the parasitic element 32 are capacitively coupled to each other, the antenna 3A operates as a first folded antenna including the feed element 31 and the parasitic element 32, and being folded at the open ends 31*d* and 32*d*. An electric length L31 of each of the feed element 31 and the parasitic element 32 capacitively coupled to each other is set to λ1/4, and therefore, an electric length of the first folded antenna is set to λ1/2, and the first folded antenna resonates at the frequency f1. Thus, the feed element 31 and the parasitic element 32 resonate at the first frequency f1 corresponding to the first wavelength λ1 determined by the sum of the electric length L31 of the feed element 31 and the electric length L31 of the parasitic element 32.

When the open end 31*d* of the feed element 31 and the open end 32*d* of the parasitic element 32 are capacitively coupled to each other, the antenna 3A further operates as a second folded antenna, the second folded antenna including a portion of the feed element 31 from a feeding point 33 to the connecting point 31*e*, the feed element 35, a portion of the feed element 31 from the connecting point 31*f* to the open end 31*d*, and the parasitic element 32, and the second folded antenna being folded at the open ends 31*d* and 32*d*. An electric length L32 of the portion of the feed element 31 from the feeding point 33 to the connecting point 31*e*, the feed element 35, and the portion of the feed element 31 from the connecting point 31*f* to the open end 31*d*, when these portions are capacitively coupled to the parasitic element 32, is set to λ2/4. An electric length L32 of the parasitic element 32, when the parasitic element 32 is capacitively coupled to the feed elements 31 and 35, is set to λ2/4. Therefore, the electric length of the second folded antenna is set to λ2/2, and the second folded antenna resonates at a frequency f2. Thus, the feed element 31, the feed element 35, and the parasitic element 32 resonate at the second frequency f2 corresponding to the second wavelength λ2 determined by the sum of the electric length L32 of the feed elements 31 and 35 and the electric length L32 of the parasitic element 32.

The feed element 35 and the parasitic element 32 may be arranged to oppose each other, at at least a portion thereof. In addition, the feed element 35 and the parasitic element 32 may be arranged to be capacitively coupled to each other, at at least a portion thereof. In addition, the feed element 35 and the parasitic element 32 may be arranged to overlap each other, at at least a portion thereof.

The antenna 4 is configured in a manner similar to that of the antenna 4 of the first embodiment.

The wireless receiving circuit of the main circuit board 103 receives radio signals having the frequencies f1 and f2 using the antennas 1A, 1B, and 1C.

Figure 18:
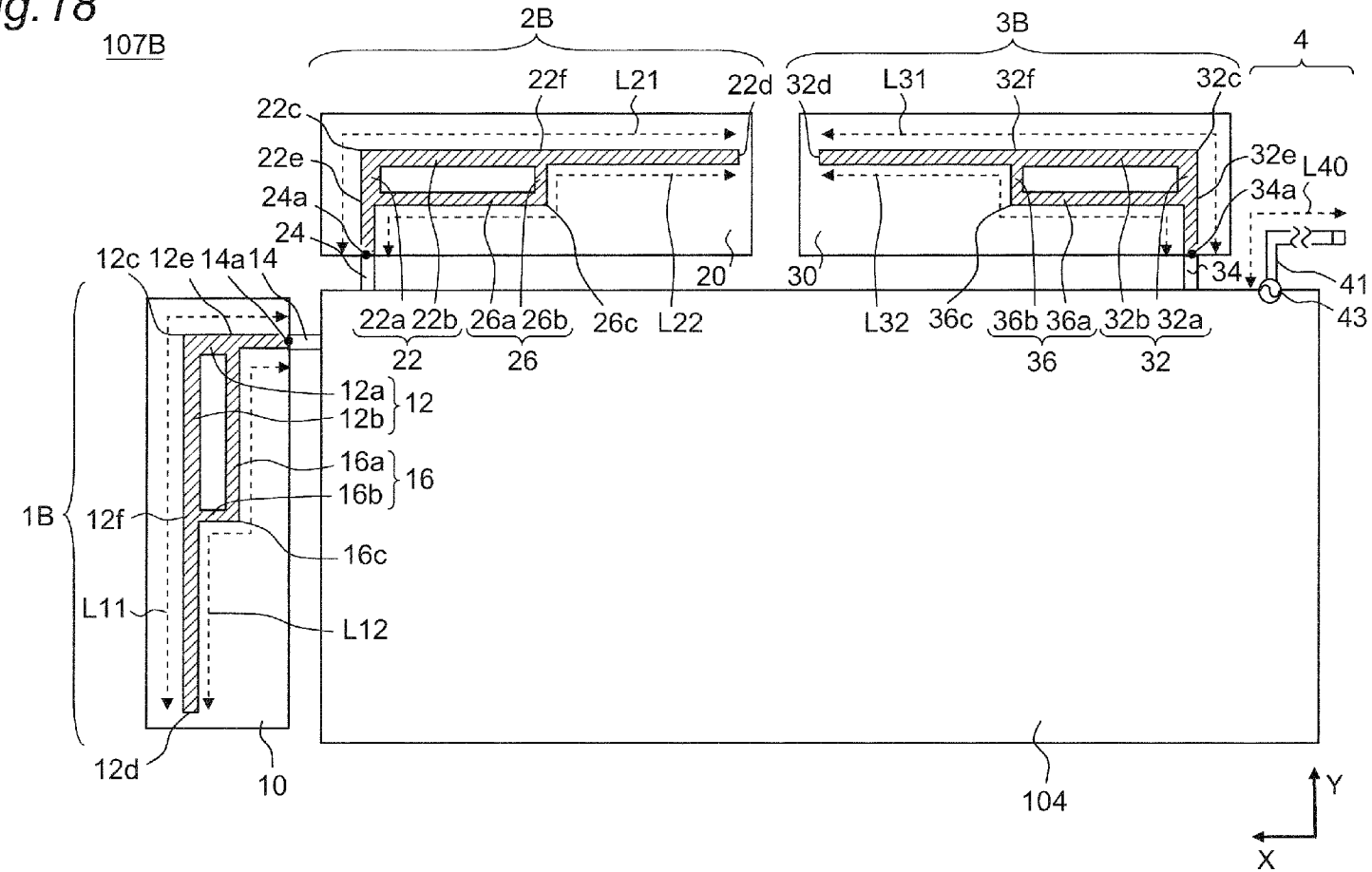
FIG. 18 is a plan view of an antenna apparatus 107B according to a modified embodiment of the second embodiment, seen from a back side thereof.

FIG. 18 is a plan view of an antenna apparatus 107B according to a modified embodiment of the second embodiment, seen from a back side thereof. Referring to FIG. 16, each parasitic element of the antennas 1A, 2A, and 3A has a different shape from that of their feed elements (FIG. 15) (i.e., a shape similar to that of each parasitic element of the antennas 1 to 3 of FIG. 5). However, as shown in FIG. 18, each parasitic element may have a shape similar to that of feed elements (FIG. 15).

The antenna apparatus 107B is provided with: antennas 1B, 2B, 3B, and 4 formed on dielectric substrates 10, 20, and 30, respectively; and a ground conductor plate 104. Front sides of the antennas 1B, 2B, and 3B are configured in a manner similar to those of the antennas 1A, 2A, and 3A of FIG. 15.

First, the antenna 1B is explained.

The antenna 1B is provided with a dielectric substrate 10, feed elements 11, 15, and a parasitic element (first parasitic element) 12, which are similar to those of the antenna 1A of FIGS. 15 and 16. The antenna 1B is further provided with a second parasitic element 16 having a strip shape and formed on the back side of the dielectric substrate 10 (FIG. 18). The parasitic element 16 is made of conductive foil, such as copper or silver. The dielectric substrate 10, the feed elements 11, 15, and the parasitic elements 12, 16 are configured as, e.g., a printed-circuit board having conductor layers on both sides.

The parasitic element 16 has a first end and a second end, the first and second ends being connected to connecting points 12*e* and 12*f* at different positions on the parasitic element 12, respectively. Referring to FIG. 18, the parasitic element 16 includes element parts 16*a* and 16*b*, which are connected to each other at a connecting point 16*c*. The element part 16*a* extends substantially toward the −Y direction from an element part 12*a* of the parasitic element 12. The element part 16*a* is connected to the element part 12*a* of the parasitic element 12 at the connecting point 12*e* located at one end of the element part 16*a*, and connected to the element part 16*b* at the connecting point 16*c* of the other end of the element part 16*a*. The element part 16*b* extends substantially toward the +X direction from the connecting point 16*c*. The element part 16*b* is connected to an element part 12*b* of the parasitic element 12 at the connecting point 12*f* located at one end of the element part 16*b*, and connected to the element part 16*a* at the connecting point 16*c* of the other end of the element part 16*b*.

When an open end 11*d* of the feed element 11 and an open end 12*d* of the parasitic element 12 are capacitively coupled to each other, the antenna 1B operates as a first folded antenna including the feed element 11 and the parasitic element 12, and being folded at the open ends 11*d* and 12*d*. An electric length L11 of each of the feed element 11 and the parasitic element 12 capacitively coupled to each other is set to λ1/4, and therefore, an electric length of the first folded antenna is set to λ1/2, and the first folded antenna resonates at the frequency f1. Thus, the feed element 11 and the parasitic element 12 resonate at the first frequency f1 corresponding to the first wavelength λ1 determined by the sum of the electric length L11 of the feed element 11 and the electric length L11 of the parasitic element 12.

When the open end 11*d* of the feed element 11 and the open end 12*d* of the parasitic element 12 are capacitively coupled to each other, the antenna 1B further operates as a second folded antenna, the second folded antenna including a portion of the feed element 11 from a feeding point 13 to the connecting point 11*e*, the feed element 15, a portion of the feed element 11 from the connecting point 11*f* to the open end 11*d*, a portion of the parasitic element 12 from a connecting point 14*a* to the connecting point 12*e*, the parasitic element 16, a portion of the parasitic element 12 from the connecting point 12*f* to the open end 12*d*, and the second folded antenna being folded at the open ends 11*d* and 12*d*. An electric length L12 of the portion of the feed element 11 from the feeding point 13 to the connecting point 11*e*, the feed element 15, and the portion of the feed element 11 from the connecting point 11*f* to the open end 11*d*, when these portions are capacitively coupled to the parasitic elements 12 and 16, is set to λ2/4. An electric length L12 of the portion of the parasitic element 12 from the connecting point 14 to the connecting point 12*e*, the parasitic element 16, and the portion of the parasitic element 12 from the connecting point 12*f* to the open end 12*d*, when these portions are capacitively coupled to the feed elements 11 and 15, is set to λ2/4. Therefore, an electric length of the second folded antenna is set to λ2/2, and the second folded antenna resonates at a frequency f2. Thus, the feed element 11, the feed element 15, the parasitic element 12, and the parasitic element 16 resonate at the second frequency f2 corresponding to the second wavelength λ2/2 determined by the sum of the electric length L12 of the feed elements 11 and 15 and the electric length L12 of the parasitic elements 12 and 16.

The feed elements 11, 15, and the parasitic element 16 may be arranged to oppose each other, at at least a portion thereof. In addition, the feed elements 11,15, and the parasitic element 16 may be arranged to be capacitively coupled to each other, at at least a portion thereof. In addition, the feed elements 11, 15, and the parasitic element 16 may be arranged to overlap each other, at at least a portion thereof.

Now, the antenna 2B is explained.

The antenna 2B is provided with a dielectric substrate 20, feed elements 21, 25, and a parasitic element (first parasitic element) 22, which are similar to those of the antenna 2A of FIGS. 15 and 16. The antenna 2B is further provided with a second parasitic element 26 having a strip shape and formed on the back side of the dielectric substrate 20 (FIG. 18). The parasitic element 26 is made of conductive foil, such as copper or silver. The dielectric substrate 20, the feed elements 21, 25, and the parasitic elements 22, 26 are configured as, e.g., a printed-circuit board having conductor layers on both sides.

The parasitic element 26 has a first end and a second end, the first and second ends being connected to connecting points 22*e* and 22*f* at different positions on the parasitic element 22, respectively. Referring to FIG. 18, the parasitic element 26 includes element parts 26*a* and 26*b*, which are connected to each other at a connecting point 26*c*. The element part 26*a* extends substantially toward the −X direction from an element part 22*a* of the parasitic element 22. The element part 26*a* is connected to the element part 22*a* of the parasitic element 22 at the connecting point 22*e* located at one end of the element part 26*a*, and connected to the element part 26*b* at the connecting point 26*c* of the other end of the element part 26*a*. The element part 26*b* extends substantially toward the +Y direction from the connecting point 26*c*. The element part 26*b* is connected to an element part 22*b* of the parasitic element 22 at the connecting point 22*f* located at one end of the element part 26*b*, and connected to the element part 26*a* at the connecting point 26*c* of the other end of the element part 26*b*.

When an open end 21*d* of the feed element 21 and an open end 22*d* of the parasitic element 22 are capacitively coupled to each other, the antenna 2B operates as a first folded antenna including the feed element 21 and the parasitic element 22, and being folded at the open ends 21*d* and 22*d*. An electric length L21 of each of the feed element 21 and the parasitic element 22 capacitively coupled to each other is set to λ1/4, and therefore, an electric length of the first folded antenna is set to λ1/2, and the first folded antenna resonates at the frequency f1. Thus, the feed element 21 and the parasitic element 22 resonate at the first frequency f1 corresponding to the first wavelength λ1 determined by the sum of the electric length L21 of the feed element 21 and the electric length L21 of the parasitic element 22.

When the open end 21*d* of the feed element 21 and the open end 22*d* of the parasitic element 22 are capacitively coupled to each other, the antenna 2B further operates as a second folded antenna, the second folded antenna including a portion of the feed element 21 from a feeding point 23 to the connecting point 21*e*, the feed element 25, a portion of the feed element 21 from the connecting point 21*f* to the open end 21*d*, a portion of the parasitic element 22 from a connecting point 24*a* to the connecting point 22*e*, the parasitic element 26, a portion of the parasitic element 22 from the connecting point 22*f* to the open end 22*d*, and the second folded antenna being folded at the open ends 21*d* and 22*d*. An electric length L22 of the portion of the feed element 21 from the feeding point 23 to the connecting point 21*e*, the feed element 25, and the portion of the feed element 21 from the connecting point 21*f* to the open end 21*d*, when these portions are capacitively coupled to the parasitic elements 22 and 26, is set to λ2/4. An electric length L22 of the portion of the parasitic element 22 from the connecting point 24 to the connecting point 22*e*, the parasitic element 26, and the portion of the parasitic element 22 from the connecting point 22*f* to the open end 22*d*, when these portions are capacitively coupled to the feed elements 21 and 25, is set to λ2/4. Therefore, an electric length of the second folded antenna is set to λ2/2, and the second folded antenna resonates at a frequency f2. Thus, the feed element 21, the feed element 25, the parasitic element 22, and the parasitic element 26 resonate at the second frequency f2 corresponding to the second wavelength λ2 determined by the sum of the electric length L22 of the feed elements 21 and 25 and the electric length L22 of the parasitic elements 22 and 26.

The feed elements 21, 25 and the parasitic elements 22, 26 may be arranged to oppose each other, at at least a portion thereof. In addition, the feed elements 21, 25 and the parasitic elements 22, 26 may be arranged to be capacitively coupled to each other, at at least a portion thereof. In addition, the feed elements 21, 25 and the parasitic elements 22, 26 may be arranged to overlap each other, at at least a portion thereof.

Now, the antenna 3B is explained.

The antenna 3B is provided with a dielectric substrate 30, feed elements 31, 35, and a parasitic element (first parasitic element) 32, which are similar to those of the antenna 3A of FIGS. 15 and 16. The antenna 3B is further provided with a second parasitic element 36 having a strip shape and formed on the back side of the dielectric substrate 30 (FIG. 18). The parasitic element 36 is made of conductive foil, such as copper or silver. The dielectric substrate 30, the feed elements 31, 35, and the parasitic elements 32, 36 are configured as, e.g., a printed-circuit board having conductor layers on both sides.

The parasitic element 36 has a first end and a second end, the first and second ends being connected to connecting points 32*e* and 32*f* at different positions on the parasitic element 32, respectively. Referring to FIG. 18, the parasitic element 36 includes element parts 36*a* and 36*b*, which are connected to each other at a connecting point 36*c*. The element part 36*a* extends substantially toward the +X direction from an element part 32*a* of the parasitic element 32. The element part 36*a* is connected to the element part 32*a* of the parasitic element 32 at the connecting point 32*e* located at one end of the element part 36*a*, and connected to the element part 36*b* at the connecting point 36*c* of the other end of the element part 36*a*. The element part 36*b* extends substantially toward the +Y direction from the connecting point 36*c*. The element part 36*b* is connected to an element part 32*b* of the parasitic element 32 at the connecting point 32*f* located at one end of the element part 36*b*, and connected to the element part 36*a* at the connecting point 36*c* of the other end of the element part 36*b*.

When an open end 31*d* of the feed element 31 and an open end 32*d* of the parasitic element 32 are capacitively coupled to each other, the antenna 3B operates as a first folded antenna including the feed element 31 and the parasitic element 32, and being folded at the open ends 31*d* and 32*d*. An electric length L31 of each of the feed element 31 and the parasitic element 32 capacitively coupled to each other is set to λ1/4, and therefore, an electric length of the first folded antenna is set to λ1/2, and the first folded antenna resonates at the frequency f1. Thus, the feed element 31 and the parasitic element 32 resonate at the first frequency f1 corresponding to the first wavelength λ1 determined by the sum of the electric length L31 of the feed element 31 and the electric length L31 of the parasitic element 32.

When the open end 31*d* of the feed element 31 and the open end 32*d* of the parasitic element 32 are capacitively coupled to each other, the antenna 3B further operates as a second folded antenna, the second folded antenna including a portion of the feed element 31 from a feeding point 33 to the connecting point 31*e*, the feed element 35, a portion of the feed element 31 from the connecting point 31*f* to the open end 31*d*, a portion of the parasitic element 32 from a connecting point 34*a* to the connecting point 32*e*, the parasitic element 36, a portion of the parasitic element 32 from the connecting point 32*f* to the open end 32*d*, and the second folded antenna being folded at the open ends 31*d* and 32*d*. An electric length L32 of the portion of the feed element 31 from the feeding point 33 to the connecting point 31*e*, the feed element 35, and the portion of the feed element 31 from the connecting point 31*f* to the open end 31*d*, when these portions are capacitively coupled to the parasitic elements 32 and 36, is set to λ2/4. An electric length L32 of the portion of the parasitic element 32 from the connecting point 34 to the connecting point 32*e*, the parasitic element 36, and the portion of the parasitic element 32 from the connecting point 32*f* to the open end 32*d*, when these portions are capacitively coupled to the feed elements 31 and 35, is set to λ2/4. Therefore, an electric length of the second folded antenna is set to λ2/2, and the second folded antenna resonates at a frequency f2. Thus, the feed element 31, the feed element 35, the parasitic element 32, and the parasitic element 36 resonate at the second frequency f2 corresponding to the second wavelength λ2 determined by the sum of the electric length L32 of the feed elements 31 and 35 and the electric length L32 of the parasitic elements 32 and 36.

The feed elements 31, 35 and the parasitic elements 32, 36 may be arranged to oppose each other, at at least a portion thereof. In addition, the feed elements 31, 35 and the parasitic elements 32, 36 may be arranged to be capacitively coupled to each other, at at least a portion thereof. In addition, the feed elements 31, 35 and the parasitic elements 32, 36 may be arranged to overlap each other, at at least a portion thereof.

[2-2. Operation]

Now, an operation of the antenna apparatus 107A configured as mentioned above is explained.

Figure 19:
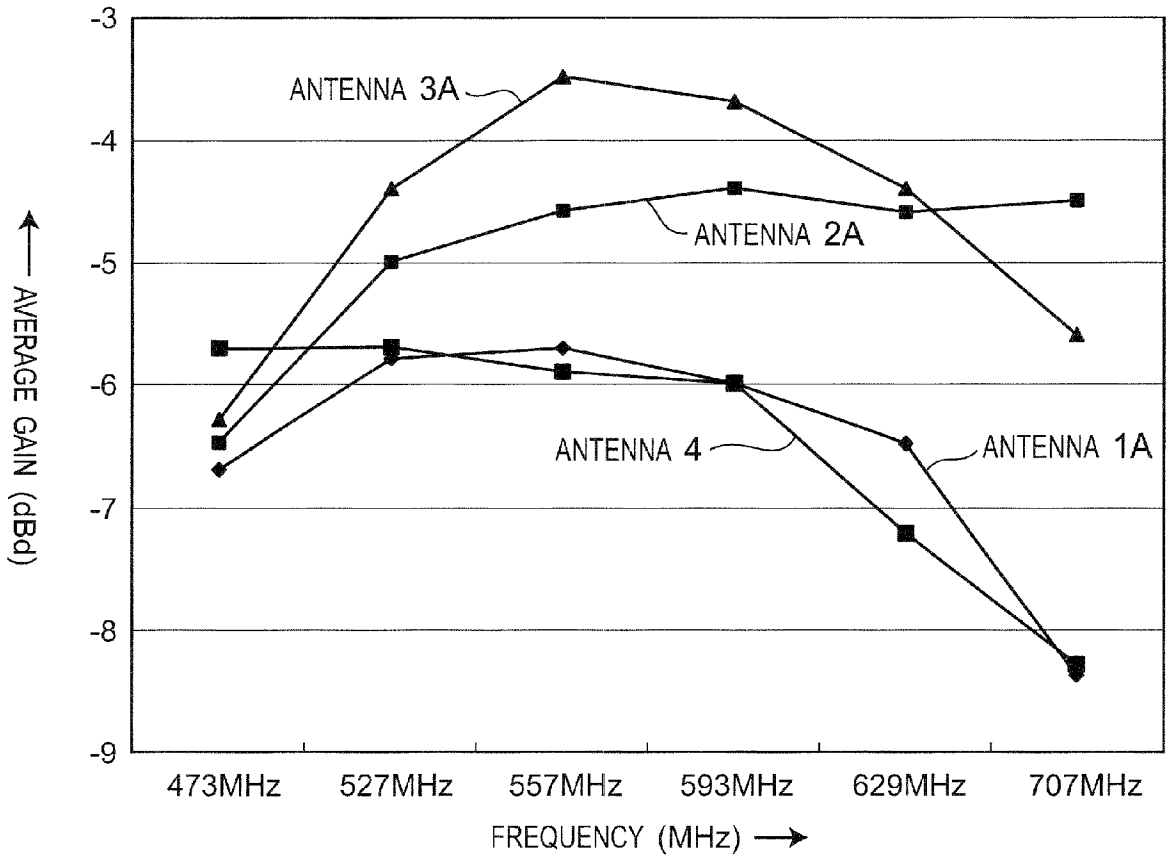
FIG. 19 is a graph showing average gain versus frequency characteristics for the antennas 1A, 2A, 3A, and 4 of FIGS. 15 and 16.

FIG. 19 is a graph showing average gain versus frequency characteristics for the antennas 1A, 2A, 3A, and 4 of FIGS. 15 and 16. The vertical axis of the graph shows an average gain under a cross polarization of −6 dB. As shown in FIG. 19, an average of the average gains of the antennas 1A, 2A, 3A, and 4 was −7.9 dBd or more at respective frequencies of the terrestrial digital television broadcast.

[2-3. Advantageous Effects, etc.]

As described above, the antenna apparatus 107A of the second embodiment is provided with the antennas 1A, 2A, 3A, and 4 and the ground conductor plate 104, and the antennas 1A, 2A, and 3A are configured in a manner similar to those of the antennas 1 to 3 of the antenna apparatus 107 of the first embodiment, and further configured as follows.

The antenna 1A is provided with the feed element 15 having the strip shape and formed on the front side of the dielectric substrate 10. The feed element 15 has the first end and the second end, the first and second ends being connected to the connecting points 11*e* and 11*f* at different positions on the feed element 11, respectively. The feed element 11 and the parasitic element 12 are arranged to be capacitively coupled to each other, at at least a portion including the open end 11*d* of the feed element 11 and the open end 12*d* of the parasitic element 12. The feed element 11 and the parasitic element 12 resonate at the frequency f1 corresponding to the wavelength λ1 determined by the sum of the electric length L11 of the feed element 11 and the electric length L11 of the parasitic element 12. The feed element 11, the feed element 15, and the parasitic element 12 resonate at the second frequency f2 corresponding to the second wavelength λ2 determined by the sum of the electric length L12 of the feed elements 11 and 15 and the electric length L12 of the parasitic element 12. The feed element 15 is arranged to be capacitively coupled to the feed element 11, at at least a portion between the first end and the second end of the feed element 15.

The antenna 2A is provided with the feed element 25 having the strip shape and formed on the front side of the dielectric substrate 20. The feed element 25 has the first end and the second end, the first and second ends being connected to the connecting points 21*e* and 21*f* at different positions on the feed element 21, respectively. The feed element 21 and the parasitic element 22 are arranged to be capacitively coupled to each other, at at least a portion including the open end 21*d* of the feed element 21 and the open end 22*d* of the parasitic element 22. The feed element 21 and the parasitic element 22 resonate at the frequency f1 corresponding to the wavelength λ1 determined by the sum of the electric length L21 of the feed element 21 and the electric length L21 of the parasitic element 22. The feed element 21, the feed element 25, and the parasitic element 22 resonate at the second frequency f2 corresponding to the second wavelength λ2 determined by the sum of the electric length L22 of the feed elements 21 and 25 and the electric length L22 of the parasitic element 22. The feed element 25 is arranged to be capacitively coupled to the feed element 21, at at least a portion between the first end and the second end of the feed element 25.

The antenna 3A is provided with the feed element 35 having the strip shape and formed on the front side of the dielectric substrate 30. The feed element 35 has the first end and the second end, the first and second ends being connected to the connecting points 31*e* and 31*f* at different positions on the feed element 31, respectively. The feed element 31 and the parasitic element 32 are arranged to be capacitively coupled to each other, at at least a portion including the open end 31*d* of the feed element 31 and the open end 32*d* of the parasitic element 32. The feed element 31 and the parasitic element 32 resonate at the frequency f1 corresponding to the wavelength λ1 determined by the sum of the electric length L31 of the feed element 31 and the electric length L31 of the parasitic element 32. The feed element 31, the feed element 35, and the parasitic element 32 resonate at the second frequency f2 corresponding to the second wavelength λ2 determined by the sum of the electric length L32 of the feed elements 31 and 35 and the electric length L32 of the parasitic element 32. The feed element 35 is arranged to be capacitively coupled to the feed element 31, at at least a portion between the first end and the second end of the feed element 35.

Since a virtual capacitor is formed between two feed elements of each antenna, each antenna resonates in a wide band including the frequency f1 and f2. Since the virtual capacitor is formed, it is possible to shorten the physical length of the feed elements at a frequency determined by the capacitance of the capacitor, and reduce the decrease in the gain in higher bands.

The antenna apparatus of the second embodiment further brings about advantageous effects of the antenna apparatus of the first embodiment.

3. Other Embodiments

As described above, the first and second embodiments have been explained as exemplary implementations of the present disclosure. However, the embodiment of the present disclosure is not limited thereto, and can be applied to configurations with changes, substitutions, additions, omissions, etc. in an appropriate manner. In addition, the components mentioned in the first and second embodiments can be combined to provide a new embodiment.

Hereinafter, other embodiments are explained collectively.

According to each of the first and second embodiments, the antenna apparatus is provided with three antennas 1 to 3, one monopole antenna, and the ground conductor plate. However, an antenna apparatus may be provided with at least one antenna and the ground conductor plate, the antenna being configured in a manner similar to that of one of the antenna 1 of FIGS. 4 and 5, the antenna 1A of FIGS. 15 and 16, and the antenna 1B of FIG. 18. In addition, the monopole antenna may be omitted, or an antenna apparatus provided with two or more monopole antennas may be provided.

In addition, the ground conductor plate 104 is not limited to be provided as a dedicated component. Other components, such as a shield plate of the electronic apparatus 100, may be used as the ground conductor plate 104 of the antenna apparatus. In addition, the ground conductor plate 104 is not limited to be rectangular, and may be arbitrarily shaped.

In addition, according to the first and second embodiments, the dielectric substrates 10, 20, and 30 are arranged at the chamfered portions of the back cover 105. However, the embodiment of the present disclosure is not restricted thereto. The dielectric substrates 10, 20, and 30 may be arranged on the same surface as that of the ground conductor plate 104, and to be in parallel to the ground conductor plate 104, respectively. The dielectric substrates 10, 20, and 30 may be arranged on a different surface from that of the ground conductor plate 104, and to be in parallel to the ground conductor plate 104, respectively.

In addition, according to the first and second embodiments, the electronic apparatus 100 receives the broadcast signals of the frequency band of the terrestrial digital television broadcast. However, the embodiment of the present disclosure is not restricted thereto. The main circuit board 103 may be provided with a wireless transmitting circuit for transmitting radio signals using the antenna apparatus, and may be provided with a wireless communication circuit for performing at least one of transmission and reception of radio signals using the antenna apparatus. The antenna apparatus provided with the antennas 1 to 4, and the wireless receiving circuit on the main circuit board 103 make up a wireless communication apparatus which performs at least one of transmission and reception of the radio signals. In addition, according to the first and second embodiments, an exemplary electronic apparatus is explained, which is the mobile apparatus for receiving the broadcast signals of the frequency band of the terrestrial digital television broadcast, and displaying their contents. However, the embodiment of the present disclosure is not restricted thereto. The embodiments of the present disclosure are applicable to the antenna apparatus described above, and to the wireless communication apparatus for performing at least one of transmission and reception of radio signals using the antenna apparatus. In addition, the embodiments of the present disclosure are applicable to an electronic apparatus, such as a mobile phone, provided with: the wireless communication apparatus described above, and the display apparatus for displaying the video signals included in the radio signals received by the wireless communication apparatus.

As described above, the applicant presents the embodiments considered to be the best mode, and other embodiments, with reference to the accompanying drawing and detailed description. These are provided to demonstrate the claimed subject matters for those skilled in the art with reference to the specific embodiments. Therefore, the components indicated to the accompanying drawings and the detailed description may include not only components essential for solving the problem, but may include other components. Therefore, even if the accompanying drawings and the detailed description include such non-essential components, it should not be judged that the non-essential components are essential. In addition, various changes, substitutions, additions, omissions, etc. can be done to the above-described embodiments within a range of claims or their equivalency.

The present disclosure is applicable to an electronic apparatus for receiving radio signals, and displaying video signals included in the received radio signals. In particular, the present disclosure is applicable to a portable television broadcast receiving apparatus, a mobile phone, a smart phone, a personal computer, etc.

The invention claimed is:

1. An antenna apparatus comprising:

a conductor plate having a prescribed shape having a first side and a second side adjacent to the first side;

a first feed element having a strip shape, a first end connected to a first feeding point, and an open second end;

a first parasitic element having a strip shape, a first end connected to the conductor plate, and an open second end, the first parasitic element isolating direct current from the first feed element, at least at a portion of the first parasitic element that is opposed to the first feed element;

a second feed element having a strip shape, a first end connected to a second feeding point, and an open second end;

a second parasitic element having a strip shape, a first end connected to the conductor plate, and an open second end, the second parasitic element isolating direct current from the second feed element, at least at a portion of the second parasitic element that is opposed to the second feed element;

a third feed element having a strip shape, a first end connected to a third feeding point, and an open second end; and a third parasitic element having a strip shape, a first end connected to the conductor plate, and an open second end, the third parasitic element isolating direct current from the third feed element, at least at a portion of the third parasitic element that is opposed to the third feed element, wherein:

the first end of the second parasitic element and the first end of the third parasitic element are located on the first side of the prescribed shape of the conductor plate, and the first end of the first parasitic element is located on the second side of the prescribed shape of the conductor plate, a distance between the first end of the second parasitic element and the first end of the third parasitic element is longer than a distance between the first end of the first parasitic element and the first end of the second parasitic element, a part of the second feed element that includes the open second end of the second feed element extends in a first direction, a part of the third feed element that includes the open second end of the third feed element extends in a second direction opposite the first direction, and a part of the first feed element that includes the open second end of the first feed element extends away from the second and third feed elements in a third direction which is orthogonal to the first and second directions.

2. The antenna apparatus according to claim 1:

wherein the prescribed shape is a quadrangle.

3. The antenna apparatus according to claim 1:

wherein an angle between the first side and the second side is substantially a right angle.

4. The antenna apparatus according to claim 1:

wherein a length of the first side is longer than a length of the second side.

5. The antenna apparatus according to claim 1:

wherein the prescribed shape is a rectangle, the first side is a long side of the rectangle, and the second side is a short side of the rectangle.

6. The antenna apparatus according to claim 1: further comprising, a first dielectric substrate having a first surface and a second surface:

wherein the first feed element is located on the first surface of the first dielectric substrate, and the first parasitic element is located on the second surface of the first dielectric substrate.

7. The antenna apparatus according to claim 1: further comprising, a second dielectric substrate having a first surface and a second surface:

wherein the second feed element is located on the first surface of the second dielectric substrate, and the second parasitic element is located on the second surface of the second dielectric substrate.

8. The antenna apparatus according to claim 1: further comprising, a third dielectric substrate having a first surface and a second surface:

wherein the third feed element is located on the first surface of the third dielectric substrate, and the third parasitic element is located on the second surface of the third dielectric substrate.

9. The antenna apparatus according to claim 1: wherein the first feed element comprises a long portion having a first length and a short portion having a second length which is shorter than the first length of the long portion of the first feed element, the second feed element comprises a long portion having a first length and a short portion having a second length which is shorter than the first length of the long portion of the second feed element, the third feed element comprises a long portion having a first length and a short portion having a second length which is shorter than the first length of the long portion of the third feed element, the long portion of the second feed element is the part of the second feed element that includes the open second end of the second feed element and the long portion of the third feed element the part of the third feed element that includes the open second end of the third feed element, and the long portion of the first feed element extends in the third direction.

10. The antenna apparatus according to claim 9: wherein the first side of the prescribed shape extends in parallel to the first and second directions, and the second side of the prescribed shape extends in parallel to the third direction.

11. The antenna apparatus according to claim 9: wherein the short portion of the first feed element has the first end of the first feed element, the short portion of the second feed element has the first end of the second feed element, and a distance between the open second end of the second feed element and the open second end of the third feed element is shorter than a distance between the first end of the second feed element and the first end of the third feed element.

12. The antenna apparatus according to claim 11: wherein the open second end of the second feed element and the open second end of the third feed element face each other.

13. The antenna apparatus according to claim 9: wherein the long portion of the first feed element is electrically connected to the short portion of the first feed element, the long portion of the second feed element is electrically connected to the short portion of the second feed element, and the long portion of the third feed element is electrically connected to the short portion of the third feed element.

14. A display apparatus comprising:

a housing;

an antenna module located in the housing and configured to receive a signal; and a display located in the housing and configured to display an image from the signal, wherein the antenna module comprises:

a conductor plate having a prescribed shape having a first side and a second side adjacent to the first side;

a first feed element having a strip shape, a first end connected to a first feeding point, and an open second end;

a first parasitic element having a strip shape, a first end connected to the conductor plate, and an open second end, the first parasitic element isolating direct current from the first feed element, at least at a portion of the first parasitic element that is opposed to the first feed element;

a second feed element having a strip shape, a first end connected to a second feeding point, and an open second end;

a second parasitic element having a strip shape, a first end connected to the conductor plate, and an open second end, the second parasitic element isolating direct current from the second feed element, at least at a portion of the second parasitic element that is opposed to the second feed element;

a third feed element having a strip shape, a first end connected to a third feeding point, and an open second end; and a third parasitic element having a strip shape, a first end connected to the conductor plate, and an open second end, the third parasitic element isolating direct current from the third feed element, at least at a portion of the third parasitic element that is opposed to the third feed element, wherein:

the first end of the second parasitic element and the first end of the third parasitic element are located on the first side of the prescribed shape of the conductor plate, and the first end of the first parasitic element is located on the second side of the prescribed shape of the conductor plate, a distance between the first end of the second parasitic element and the first end of the third parasitic element is longer than a distance between the first end of the first parasitic element and the first end of the second parasitic element, a part of the second feed element that includes the open second end of the second feed element extends in a first direction, a part of the third feed element that includes the open second end of the third feed element extends in a second direction opposite the first direction, a part of the first feed element that includes the open second end of the first feed element extends away from the second and third feed elements in a third direction which is orthogonal to the first and second directions, and the conductor plate overlaps the display.

15. The display apparatus according to claim 14: wherein the housing has at least a first side and a second side opposing to the first side, and the conductor plate is located between the display and the second side of the housing.

16. The display apparatus according to claim 15: wherein the image of the display passes through the first side of the housing.

17. The display apparatus according to claim 14: wherein a portion of the first feed element, a portion of the second feed element, and a portion of the third feed element are located outside a perimeter of the display and inside of the housing, and the portion of the first feed element, the portion of the second feed element, and the portion of the third feed element do not overlap a front or back side of the display.

18. The display apparatus according to claim 17: wherein a portion of the first parasitic element, a portion of the second parasitic element, and a portion of the third parasitic element are located outside the perimeter of the display and inside of the housing, and the portion of the first parasitic element, the portion of the second parasitic element, and the portion of the third parasitic element do not overlap the front or back side of the display.

19. The display apparatus according to claim 14: wherein the part of the second feed element that includes the open second end of the second feed element, and the part of the third feed element that includes the open second end of the third feed element are collinear.

20. The antenna apparatus according to claim 1: wherein the part of the second feed element that includes the open second end of the second feed element, and the part of the third feed element that includes the open second end of the third feed element are collinear.

* * * * *